US011324253B2

(12) United States Patent
Liu et al.

(10) Patent No.: US 11,324,253 B2
(45) Date of Patent: May 10, 2022

(54) DISPOSABLE CIGARETTE CARTRIDGE, ATOMIZER AND ELECTRONIC CIGARETTE

(71) Applicant: CHINA TOBACCO HUNAN INDUSTRIAL CO., LTD., Hunan (CN)

(72) Inventors: Jianfu Liu, Hunan (CN); Kejun Zhong, Hunan (CN); Xiaoyi Guo, Hunan (CN); Wei Huang, Hunan (CN); Yuangang Dai, Hunan (CN); Xinqiang Yin, Hunan (CN); Jianhua Yi, Hunan (CN); Hong Yu, Hunan (CN); Youlin He, Hunan (CN); Yongquan Zhou, Hunan (CN)

(73) Assignee: CHINA TOBACCO HUNAN INDUSTRIAL CO., LTD., Hunan (CN)

( * ) Notice: Subject to any disclaimer, the term of this patent is extended or adjusted under 35 U.S.C. 154(b) by 665 days.

(21) Appl. No.: 16/322,737

(22) PCT Filed: May 2, 2017

(86) PCT No.: PCT/CN2017/082734
§ 371 (c)(1),
(2) Date: Feb. 1, 2019

(87) PCT Pub. No.: WO2018/024004
PCT Pub. Date: Feb. 8, 2018

(65) Prior Publication Data

US 2021/0378303 A1 Dec. 9, 2021

(30) Foreign Application Priority Data

| | | |
|---|---|---|
| Aug. 4, 2016 | (CN) | 201610631410.5 |
| Oct. 20, 2016 | (CN) | 201621140740.6 |
| Dec. 20, 2016 | (CN) | 201621401164.6 |

(51) Int. Cl.
*A24F 40/46* (2020.01)
*A24F 40/05* (2020.01)
(Continued)

(52) U.S. Cl.
CPC ..... *A24F 40/05* (2020.01); *A24F 40/42* (2020.01); *A24F 40/44* (2020.01); *A24F 40/46* (2020.01);
(Continued)

(58) Field of Classification Search
CPC ..... A24F 40/10; A24F 40/42; A24F 40/46; A24F 40/485; A24F 40/40; B15B 17/0646
(Continued)

(56) References Cited

U.S. PATENT DOCUMENTS

| | | | | |
|---|---|---|---|---|
| 10,645,975 | B2 * | 5/2020 | Qiu | A24F 40/44 |
| 2015/0047658 | A1 | 2/2015 | Cyphert et al. | |
| 2019/0269177 | A1 * | 9/2019 | Liu | A24F 40/00 |

FOREIGN PATENT DOCUMENTS

| | | | |
|---|---|---|---|
| CN | 104770900 | A | 7/2015 |
| CN | 204861187 | U | 12/2015 |

(Continued)

OTHER PUBLICATIONS

International Search Report Issued in International Application No. PCT/CN2017/082734 dated Jul. 27, 2017.

*Primary Examiner* — Hae Moon Hyeon
(74) *Attorney, Agent, or Firm* — Mauriel Kapouytian Woods LLP; Tzvi Hirshaut; Michael Mauriel

(57) ABSTRACT

A disposable cigarette cartridge, atomizer and electronic cigarette, wherein the disposable cigarette cartridge comprises a hollow shell, a tobacco tar storage device located in the shell, a suction nozzle connected with the upper end of the shell, a tobacco tar guide seat connected with the lower
(Continued)

end of the shell, and a tobacco tar guide body installed on the tobacco tar guide seat; the tobacco tar guide body extends into the tobacco tar storage device; and an air passage is arranged in the shell, one end of the air passage is communicated with the suction nozzle, and the other end of the air passage is communicated with a heating surface of the tobacco tar guide body.

24 Claims, 27 Drawing Sheets

(51) Int. Cl.

| | |
|---|---|
| ***A24F 40/42*** | (2020.01) |
| ***A24F 40/485*** | (2020.01) |
| ***A24F 40/44*** | (2020.01) |
| ***B05B 17/00*** | (2006.01) |
| *A24F 40/10* | (2020.01) |

(52) U.S. Cl.
CPC ..... *A24F 40/485* (2020.01); *B05B 17/0646* (2013.01); *A24F 40/10* (2020.01)

(58) Field of Classification Search
USPC ..... 131/328, 329
See application file for complete search history.

(56) References Cited

FOREIGN PATENT DOCUMENTS

| | | | |
|---|---|---|---|
| CN | 105559151 | A | 5/2016 |
| CN | 105795526 | A | 7/2016 |
| CN | 205947126 | U | 2/2017 |
| CN | 206025228 | U | 3/2017 |
| CN | 206043434 | U | 3/2017 |
| CN | 206043450 | U | 3/2017 |
| CN | 206119184 | U | 4/2017 |
| CN | 206119185 | U | 4/2017 |
| EP | 2 829 183 | A1 | 1/2015 |

* cited by examiner

DISPOSABLE CIGARETTE CARTRIDGE, ATOMIZER AND ELECTRONIC CIGARETTE

CROSS REFERENCE TO RELATED APPLICATIONS

This application is a national phase application of international application number PCT/CN2017/082734 filed on May 2, 2017, which claims priority to Chinese application number 201610631410.5 filed on Aug. 4, 2016, Chinese application number 201621140740.6 filed on Oct. 20, 2016, and Chinese application number 201621401164.6 filed Dec. 20, 2016.

FIELD OF THE INVENTION

The present invention belongs to the technical field of electronic cigarettes, and particularly relates to a disposable cigarette cartridge, an atomizer, and an electronic cigarette.

BACKGROUND OF THE INVENTION

At present, electronic cigarette has become a relatively mature smoking alternative on the market. An atomizer is generally powered by a battery, the atomizer includes a tobacco tar storage cavity and an electric heating wire or an atomizing sheet arranged in the tobacco tar storage cavity, and the atomizer heats tobacco tar to generate smoke under electric driving, thereby enabling a user to obtain smoking experience.

The electronic cigarette in the prior art has the following disadvantages:

First, the tobacco tar cavity is arranged in the shell and is in direct contact with the inner wall of the shell, the user needs to inject the tobacco tar by himself in use, microorganisms such as bacteria or impurities are inevitably brought into the atomizer in a tobacco tar injection process, the quality guarantee period of the tobacco tar is shortened or the smoke taste is affected, thus affecting the user experience; and meanwhile the tobacco tar injection process is cumbersome and the electronic cigarette is inconvenient to use.

Second, the air pressure generated during the normal operation of an ultrasonic atomizing sheet will rush a tobacco tar guide body which is used for guiding the tobacco tar away from the surface of the ultrasonic atomizing sheet to affect the atomization effect, so that the amount of smoke is small.

Third, the cavitation effect generated during the normal operation of the ultrasonic atomizing sheet generates a high temperature, which is liable to cause carbonization damage to the tobacco tar guide body. The existing tobacco tar guide body, the tobacco tar storage device and the ultrasonic atomizing sheet are generally made into an entirety and cannot be randomly changed, and the entirety needs to be changed once a certain component is damaged, so that the use cost is high.

Fourth, the atomizing surface of the ultrasonic atomizing sheet is in contact with the tobacco tar guide body, and the tobacco tar guide body is directly communicated with a suction nozzle. As the ultrasonic atomizing sheet also ejects granular tobacco tar beads while spraying the smoke, and the tobacco tar beads are directly sprayed onto the mouth of the user along an air outlet passage, so that the tobacco tar is wasted, and the user experience is poor.

SUMMARY OF THE INVENTION

The tobacco tar needs to be injected into the existing electronic cigarette by the user, so that the existing electronic cigarette is inconvenient and unsanitary to use, the amount of smoke is small, the replacement of the tobacco tar guide body is inconvenient, the use cost is high, and the user experience is poor. The object of the invention is to provide a disposable cigarette cartridge, an atomizer, and an electronic cigarette in view of the shortcomings of the above prior art.

In order to solve the above technical problems, the present invention adopts the following technical solution:

A disposable cigarette cartridge structurally includes a hollow shell, a tobacco tar storage device located in the shell, a suction nozzle connected with the upper end of the shell, a tobacco tar guide seat connected with the lower end of the shell, and a tobacco tar guide body installed on the tobacco tar guide seat; the tobacco tar guide body extends into the tobacco tar storage device; and an air passage is arranged in the shell, one end of the air passage is communicated with the suction nozzle, and the other end of the air passage is communicated with a heating surface of the tobacco tar guide body.

By means of the above structure, the cigarette cartridge is disposable, and meanwhile the tobacco tar guide body is integrally changed, thereby facilitating the user replacing and carrying it, being more sanitary and being more effective to improve the sealing property and the safety of the tobacco tar.

As a preferred mode, the tobacco tar guide seat includes a base, and a tobacco tar pass hole which penetrates through the base in the vertical direction; and the tobacco tar storage device is arranged on an upper surface of the tobacco tar guide seat, and the tobacco tar guide body is inserted from the lower end of the tobacco tar pass hole and penetrates through the upper end of the tobacco tar pass hole until propping against the tobacco tar storage device.

Further, the air passage includes a vent hole which penetrates through the base in the vertical direction, and an air pipe with one end communicated with the suction nozzle and the other end communicated with the vent hole.

As a preferred mode, two tobacco tar pass holes are provided and are symmetrically arranged on the two sides of the vent hole; a salient which extends downward and supports the inner side of the tobacco tar guide body is arranged on the edge of one side of each tobacco tar pass hole close to the vent hole on the lower surface of the base, salients are symmetric with respect to the vent hole; and the tobacco tar guide body is inserted from the lower end of the tobacco tar pass hole and penetrates through the upper end of the tobacco tar pass hole to form a U-shaped structure.

By means of the above structure, the salient is used for supporting the tobacco tar guide body, so that the tobacco tar guide body forms better surface contact with the ultrasonic atomizing sheet, the supported tobacco tar guide body area directly acts on a high-frequency vibration area of the ultrasonic atomizing sheet to generate a large amount of smoke, and meanwhile the following situation is avoided: the ultrasonic atomizing sheet vibrates to generate the cavitation effect with the tobacco tar guide body due to vibration to generate a high temperature to carbonize the tobacco tar guide body (tobacco tar guide cotton). The tobacco tar guide body forms a U-shaped structure, so that the airflow can take away the smoke from the side face of the U-shaped structure.

Further, a gap is reserved between the air passage and the lower end of the suction nozzle.

The gap can prevent condensed smoke droplets in the air passage from being sucked into the mouth.

In a preferred mode, the tobacco tar storage device is a tobacco tar storage body impregnated with tobacco tar and located in the inner cavity of the shell.

The tobacco tar is stored in a tobacco tar storage medium to prevent the phenomenon of tobacco tar leakage due to the supersaturation of the tobacco tar guide cotton.

As another preferred mode, the tobacco tar storage device is a tobacco tar cavity arranged in the shell, and the tobacco tar cavity is filled with tobacco tar.

As a preferred mode, a tobacco tar cup component is arranged in the shell, the tobacco tar cup component includes a sealed tobacco tar cup shell and a tobacco tar cavity located in the tobacco tar cup shell; the bottom of the tobacco tar cup shell of the tobacco tar cup component is sealed by the tobacco tar guide seat, a recessed portion is arranged at the middle of the tobacco tar guide seat, and a tobacco tar isolation seat is installed in the recessed portion; the tobacco tar isolation seat is T-shaped and includes a vertical portion and a flange edge located at the top of the vertical portion, the vertical portion is inserted into the recessed portion, a first gap is reserved between the vertical portion and the inner wall of the recessed portion, the tobacco tar guide cotton is arranged in the first gap, and a tobacco tar pass hole communicated with the tobacco tar cavity is formed in a position corresponding to the tobacco tar guide cotton on the flange edge; and the outer wall of the vertical portion is wrapped with the tobacco tar guide body, the side face of the tobacco tar guide body props against the tobacco tar guide cotton, and the bottom of the tobacco tar guide body props against the ultrasonic atomizing sheet.

By means of the above structure, the tobacco tar cup component is disposable and can be replaced independently, and the tobacco tar is injected and sealed before leaving the factory, thereby being clean and sanitary, reducing the use cost, being convenient to use and being unlikely to generate the tobacco tar leakage phenomenon.

Further, a cotton pressing spring is sleeved on the lower end of the vertical portion, the cotton pressing spring is wrapped by the tobacco tar guide body, and the lower end of the cotton pressing spring props against the inner surface of the bottom of the tobacco tar guide body.

Further, the disposable cigarette cartridge further includes a tobacco tar bead blocking structure, and the tobacco tar bead blocking structure props against one surface of the tobacco tar guide body away from the ultrasonic atomizing sheet; the tobacco tar bead blocking structure includes a tower spring, a pitch value of the tower spring is less than or equal to a line diameter value of the tower spring, the tower spring is located on one side where the atomizing surface of the ultrasonic atomizing sheet is located, and the center line of the tower spring is vertical to the ultrasonic atomizing sheet.

By means of the above structure, the tobacco tar beads ejected from the ultrasonic atomizing sheet can be blocked by the tobacco tar bead blocking structure. Due to the lateral spacing (i.e., the distance between adjacent spring rings) of the tower spring, the airflow can bypass the spring rings and smoothly flow by the tower spring along the longitudinal direction; and on the longitudinal direction of the tower spring, as the pitch value of the tower spring is less than or equal to the line diameter value of the tower spring, the tower spring is projected on the bottom plane to form a whole plane in which the line diameters are connected with and flush with the line diameters, and after the ultrasonic atomizing sheet sprays the tobacco tar beads into the inner part of the tower spring (the ejection direction is parallel to the center line of the tower spring), the tobacco tar beads are blocked by the tower spring and are not splashed into the mouth of the user. At the same time, since the tobacco tar beads sprayed onto the tower spring will flow back downward along the spiral direction of the tower spring and are reheated and atomized, the utilization rate of the tobacco tar is high, and the user experience is good.

Further, the tobacco tar bead blocking structure further includes a pressing member fixedly arranged at the bottom of the tower spring, an air outlet groove is formed in the pressing member, and the pressing member props against the atomizing surface of the ultrasonic atomizing sheet.

By the above structure, the good contact between the tobacco tar guide body and the ultrasonic atomizing sheet can be ensured by the pressing member, and the tobacco tar guide body can be prevented from being rushed away from the atomizing surface by the ejection force during the work of the ultrasonic atomizing sheet, thereby ensuring the atomization effect and increasing the amount of smoke. As the air outlet groove is formed in the pressing member, the normal ejection of the smoke from the ultrasonic atomizing sheet is not blocked.

As a preferred mode, the pressing member is a non-contact planar spiral spring that is vertical to the tower spring.

The spacing of the non-contact planar spiral spring is greater than a multiple line diameter and does not affect the smoke injection of the ultrasonic atomizing sheet.

As a preferred mode, the tower spring is fixedly connected with the pressing member through a cylindrical spring which is coaxial with the tower spring, the top of the tower spring is connected with the top of the cylindrical spring, the bottom of the cylindrical spring is integrally formed with the non-contact planar spiral spring, and the diameters of the coils of the tower spring decrease progressively from top to bottom.

As another preferred mode, the tower spring is fixedly connected with the pressing member through a cylindrical spring which is coaxial with the tower spring, the bottom of the tower spring is integrally formed with the top of the cylindrical spring, the bottom of the cylindrical spring is integrally formed with the non-contact planar spiral spring, and the diameters of the coils of the tower spring increase progressively from top to bottom.

In a second preferred solution, the tobacco tar bead blocking structure is designed to be integrally formed, so that the manufacturing cost can be reduced, the assembly difficulty can be reduced, and the working reliability can be improved.

Further, the disposable cigarette cartridge further includes an air pipe, a cigarette cartridge connecting sleeve is connected to the bottom of the side wall of the shell, the tobacco tar guide seat is arranged in the cigarette cartridge connecting sleeve, the tobacco tar guide body is a U-shaped tobacco tar guide cotton sheet, the tobacco tar cavity which accommodates the tobacco tar is enclosed among the tobacco tar guide seat, the shell and the air pipe, the bottom surface of the tobacco tar guide body is located below the tobacco tar guide seat, and the two side walls of the tobacco tar guide body are communicated with the tobacco tar cavity through the tobacco tar pass hole in the tobacco tar guide seat; a vertical vent hole is formed in the tobacco tar guide seat, and the vent hole is communicated with the outside through the air pipe; and a limiting portion which props against the top end of the cylindrical spring is arranged on the side wall of the vent hole, and the non-contact planar spiral spring props against the inner bottom surface of the tobacco tar guide body.

By means the above structure, the cigarette cartridge is designed as an independent replaceable structure, which is convenient to carry, convenient to use and clean and sanitary. At the same time, if the tobacco tar guide body in the cigarette cartridge is damaged by carbonization, the tobacco tar guide body can be replaced separately.

Based on the same inventive concept, the present invention further provides an atomizer, including an atomizing core component, wherein the atomizing core component includes an ultrasonic atomizing sheet, the atomizer further includes the disposable cigarette cartridge, and the outer bottom surface of the tobacco tar guide body props against the atomizing surface of the ultrasonic atomizing sheet.

Based on the same inventive concept, the present invention further provides an electronic cigarette, including a power supply module, the electronic cigarette further includes the atomizer, and the power supply module is electrically connected with the ultrasonic atomizing sheet.

As a preferred mode, the disposable cigarette cartridge is detachably connected with the atomizing core component, the power supply module is electrically connected with the lower end of the atomizing core component, the tobacco tar guide seat is fixed in a cigarette cartridge connecting sleeve, and the cigarette cartridge connecting sleeve is connected with the upper end of the atomizing core component.

The modular electronic cigarette is composed of three large modules, namely, the cigarette cartridge, the atomizing core component and the power supply module, the cigarette cartridge can be conveniently replaced, and the atomizing core component and the power supply module can also be randomly replaced, so that the service life of the entire electronic cigarette can be prolonged, meanwhile the ultrasonic atomizing sheet can also be replaced, the consistency of the atomization effect can be kept, and the problem that the amount of smoke is continuously decreased due to the slow failure of the ultrasonic atomizing sheet is solved.

As a preferred mode, the atomizing core component includes a hollow atomizing core shell, an air inlet hole located in the wall of the atomizing core shell, a silica gel seat arranged in a hollow cavity of the atomizing core shell, an ultrasonic atomizing sheet arranged on the silica gel seat, a connecting electrode electrically connected with the ultrasonic atomizing sheet, and a pressing device which presses the ultrasonic atomizing sheet; the air inlet hole is communicated with the hollow cavity of the atomizing core shell; the pressing device is detachably connected with the tobacco tar guide seat, and after assembly and connection, the tobacco tar guide body props against the atomizing surface of the ultrasonic atomizing sheet, and the hollow cavity of the atomizing core shell is communicated with the air passage of the disposable cigarette cartridge.

Further, a heat dissipation hole is formed in the bottom of the atomizing core shell, and the heat dissipation hole is communicated with the hollow cavity of the atomization core shell.

The air inlet hole provides external air required for smoking, and the heat dissipation hole provides a cooling passage for the heat generated by the cavitation effect generated during the work of the ultrasonic atomizing sheet.

Further, the pressing device includes a pressing seat connected with the atomizing core shell, an annular conductive sheet is arranged between the pressing seat and the silica gel seat, a pressing lug is arranged on the conductive sheet, and the pressing lug props against the edge of the ultrasonic atomizing sheet.

By means of the above structure, the pressing lug is pressed on the ultrasonic atomizing sheet to ensure efficient transmission of electric energy and wave frequency, and is easy to install without damaging the ultrasonic atomizing sheet.

Further, a vent groove is formed in the lower end of the pressing seat, and the vent groove is communicated with the air inlet hole and the hollow cavity of the atomizing core shell.

The airflow enters the atomizing surface of the ultrasonic atomizing sheet from the vent groove.

As a preferred mode, the power supply module includes a power supply shell, a battery core located in the power supply shell, a power supply control board and an atomizing control board electrically connected with the battery core, and a switch which controls the on-off state of the power supply control board; and an electrode ring that can be electrically conductive with the lower end of the atomizing core component is arranged at the top of the power supply shell, and the electrode ring is electrically connected with the atomizing control board.

Further, a heat dissipation passage is formed in the wall of the power supply shell.

Further, the atomizing core component includes a hollow atomizing core shell, a heat dissipation hole is formed in the bottom of the atomizing core shell, and the heat dissipation hole is communicated with the hollow cavity of the atomizing core shell; and an air guide groove is formed at the top of the power supply shell, which is in a connection site of the top of the power supply shell and the atomizing core component, and the air guide groove is communicated with the heat dissipation hole.

As a preferred mode, a groove is formed in the top of the power supply module, the atomizing core component is arranged in the groove, and the top of the atomizing core component is flush with the top of the power supply module.

By means of the above structure, the atomizing core component is built in the power supply module, so that the structure is smaller in volume and is convenient to assemble and carry.

As a preferred mode, the electronic cigarette includes an air inlet, a suction nozzle component installed at the top of the shell, an ultrasonic atomizing sheet arranged in the shell, and a connecting electrode installed at the bottom of the shell, the tobacco tar cup component props against the ultrasonic atomizing sheet, and the tobacco tar guide body props against the ultrasonic atomizing sheet; the suction nozzle component is detachably connected with the top of the shell, and the tobacco tar cup component is detachably connected with the shell; an air inlet passage communicated with the air inlet is formed in the shell, and the air inlet passage extends to the atomizing surface of the ultrasonic atomizing sheet; and an air outlet passage communicated with the suction nozzle component is arranged in the shell, and the ultrasonic atomizing sheet is electrically connected with the connecting electrode.

As a preferred mode, a second gap is reserved between the outer wall of the tobacco tar cup shell of the tobacco tar cup component and the inner wall of the shell, and the second gap forms a first air inlet passage; an elastic sheet is arranged around the edge of the ultrasonic atomizing sheet, a first air pass groove communicated with the first air inlet passage is formed in the elastic sheet, and the first air pass groove is communicated with the atomizing surface of the ultrasonic atomizing sheet; a first air pass hole communicated with the first air inlet passage is formed in the lower part of the tobacco tar guide body, and a first air outlet hole is formed in the bottom of the tobacco tar guide body; and the air outlet passage includes an air pipe located in the tobacco tar cup component, one end of the air pipe is communicated with the suction nozzle component, and the other end of the air pipe penetrates through the tobacco tar isolation seat, is inserted into a center hole of the cotton pressing spring and is communicated with the first air outlet hole.

Further, a segment of flexible pipe is arranged between the air pipe and the first air outlet hole, and one end of the flexible pipe props against the inner bottom surface of the tobacco tar guide body and is communicated with the first air outlet hole; and the other end of the flexible pipe is sleeved with the air pipe.

When the tobacco tar cup component is replaced, the suction nozzle component presses the tobacco tar cup component downward, so that the tobacco tar guide body props against the ultrasonic atomizing sheet, and the purpose of using the flexible pipe is to prevent the tobacco tar guide body from being damaged by an overlarge pressure. Further, the suction nozzle component includes a suction nozzle seat and a suction nozzle installed on the suction nozzle seat, a through-hole communicated with the suction nozzle is formed in the suction nozzle seat, and the through-hole is communicated with the air pipe; and the suction nozzle seat is detachably connected with the top of the shell.

Further, the shell of the tobacco tar cup component is made of a transparent material, the air inlet is arranged at a position corresponding to the tobacco tar cup shell in the side wall of the shell, and the length of the air inlet is equal to the height of the tobacco tar cavity. In the solution, the air inlet can be both used for ventilating and observing the remaining amount of tobacco tar.

In another preferred mode, the air inlet is arranged at a position aligned to the ultrasonic atomizing sheet in the wall of the shell, a flexible air guide sheet is arranged above the ultrasonic atomizing sheet, the air guide sheet includes a sheet-like body, a second air pass hole located at the middle of the sheet-like body, and a boss arranged around the edge of the sheet-like body, and a second air pass groove is formed in the boss; a second air inlet passage is formed between the air guide sheet and the ultrasonic atomizing sheet, a third air pass hole communicated with the second air inlet passage is formed in the lower part of the tobacco tar guide body, and a second air outlet hole is formed in the bottom of the tobacco tar guide body; the tobacco tar guide seat of the tobacco tar cup component props against the boss of the air guide sheet, and a first air outlet passage is formed between the bottom of the tobacco tar guide seat and the sheet-like body; a third air outlet hole is formed in a position aligned to the first air outlet passage on the side face of the tobacco tar guide body; a third gap is reserved between the outer wall of the tobacco tar cup shell of the tobacco tar cup component and the inner wall of the shell, the third gap forms a second air outlet passage, and the second air outlet passage is communicated with the first air outlet passage; a fourth gap is reserved between the suction nozzle component and the top of the tobacco tar cup shell of the tobacco tar cup component, the fourth gap forms a third air outlet passage, and the third air outlet passage is communicated with the second air outlet passage and the suction nozzle component.

Further, the suction nozzle component includes a suction nozzle seat and a suction nozzle installed on the suction nozzle seat, and a through-hole communicated with the suction nozzle is formed in the suction nozzle seat; a side hole communicated with the third air outlet passage is formed in the side edge of the suction nozzle seat; and the suction nozzle seat is detachably connected with the top of the shell.

As a preferred mode, the electronic cigarette includes an electronic cigarette shell, a battery bracket in the electronic cigarette shell and a top cover at the top of the electronic cigarette shell, an atomizing seat thread sleeve is sleeved in a top opening of the top cover, the atomizing seat thread sleeve is provide at the top of the battery bracket, the atomizing core component is fixedly arranged in the atomizing seat thread sleeve, the atomizing core component includes a silica gel seat and an ultrasonic atomizing sheet carried on the silica gel seat, and the top surface of the ultrasonic atomizing sheet is in contact with the outer bottom surface of the tobacco tar guide body; and an air inlet groove communicated with the top surface of the ultrasonic atomizing sheet is formed in the top of the side wall of the atomizing seat thread sleeve.

By means of the above structure, as the air inlet groove is formed in the top of the side wall of the atomizing seat thread sleeve, the tobacco tar in the atomizing core component can be prevented from flowing into the battery or a circuit board in the electronic cigarette shell, thereby protecting the circuit structure in the electronic cigarette and prolonging the service life of the electronic cigarette. At the same time, since the air inlet groove is formed in the root of the suction nozzle, compared with the manner that the air inlet hole is formed in the side wall of the electronic cigarette in the prior art, the side wall of the electronic cigarette is held by hand when the present invention is used, and the air inlet groove of the present invention is not easily blocked by the hand, and is convenient and reliable to use.

As a preferred mode, the electronic cigarette further includes a pressing connecting sleeve and a fixing seat, the cigarette cartridge connecting sleeve is detachably and fixedly connected with the fixing seat, a flange which presses and fixes the fixing seat is arranged at the top of the inner side wall of the pressing connecting sleeve, and the outer side wall of the pressing connecting sleeve is screwed with the atomizing seat thread sleeve; and a first air guide hole is formed in the side wall of the pressing connecting sleeve, a second air guide hole is formed in the side wall of the fixing seat, and the air inlet groove is communicated with the atomizing surface of the ultrasonic atomizing sheet through the first air guide hole and the second air guide hole successively.

By means of the above structure, during the assembly, firstly, the cigarette cartridge connecting sleeve and the fixing sleeve are assembled, the atomizing core component is installed in the atomizing seat thread sleeve, and then the fixing seat and the atomizing core component are pressed and fixed by the pressing connecting sleeve. When the ultrasonic atomizing sheet or the tobacco tar guide body needs to be replaced, the electronic cigarette is disassembled in a reverse order of the assembly sequence, and the parts can be replaced separately, thereby prolonging the overall service life of the electronic cigarette, reducing the use cost, and reducing the resource waste.

As a preferred mode, a salient is arranged on the outer side wall of the cigarette cartridge connecting sleeve, a neck corresponding to the salient is formed in the inner side wall of the fixing seat, a rotating guide rail communicated with the bottom of the neck is formed in the side wall of the fixing seat, and an in-place prompting convex rib is arranged on the rotating guide rail.

By means of the above structure, the salient is arranged on the cigarette cartridge connecting sleeve for clamping the cigarette cartridge connecting sleeve and the fixing seat when being inserted into the fixing seat; the rotating guide rail and the neck are used for limiting the rotation of the salient when the cigarette cartridge is assembled, the in-place prompting convex rib is used for generating in-place hand feeling and sound prompt when the cigarette cartridge is rotated in place, so that the disassembly and assembly are convenient, the work is reliable and the user experience is good.

Compared with the prior art, by adoption of the present invention, the user does not need to inject the tobacco tar by himself, thereby facilitating the user to replace and carry and being more sanitary, the sealing property of the tobacco tar is good, the amount of smoke is large, the taste of the smoke is good, the components can be replaced independently, the use cost is low, and the user experience is good.

REFERENCE SIGNS

Figure 1:
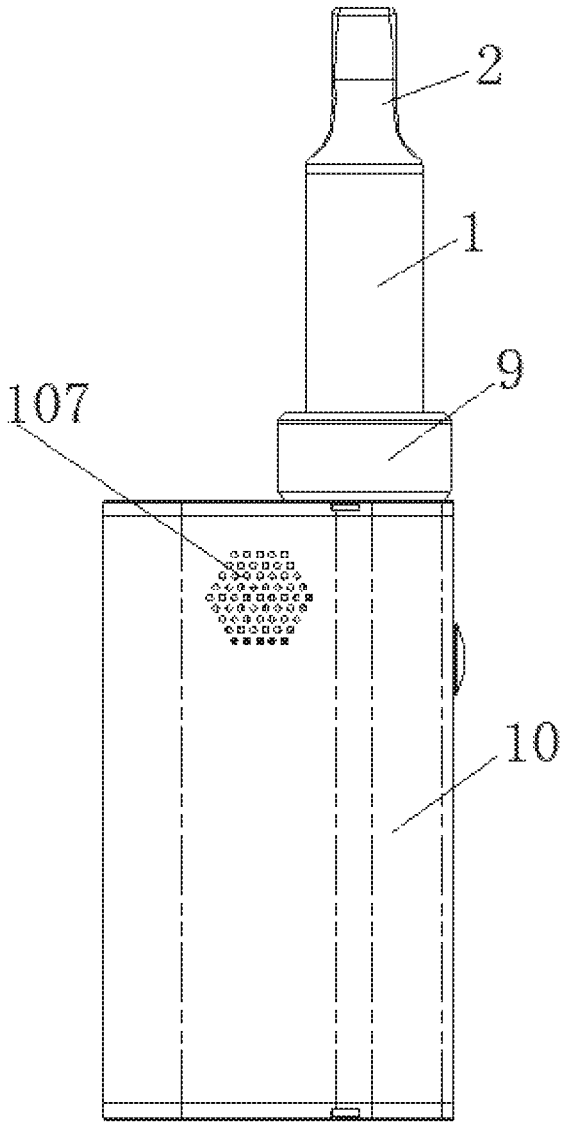
FIG. 1 is an external view of an electronic cigarette in an embodiment 1.
Figure 2:
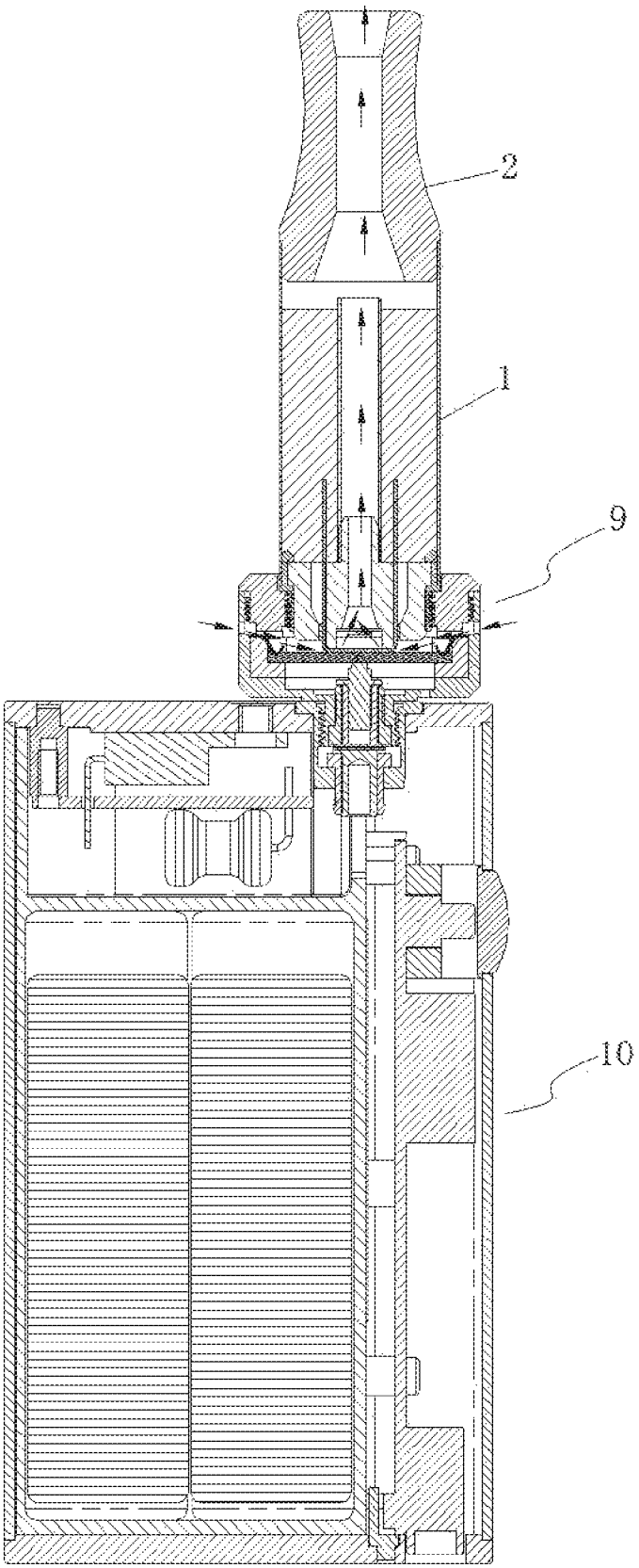
FIG. 2 is a section view of the electronic cigarette in the embodiment 1.
Figure 3:
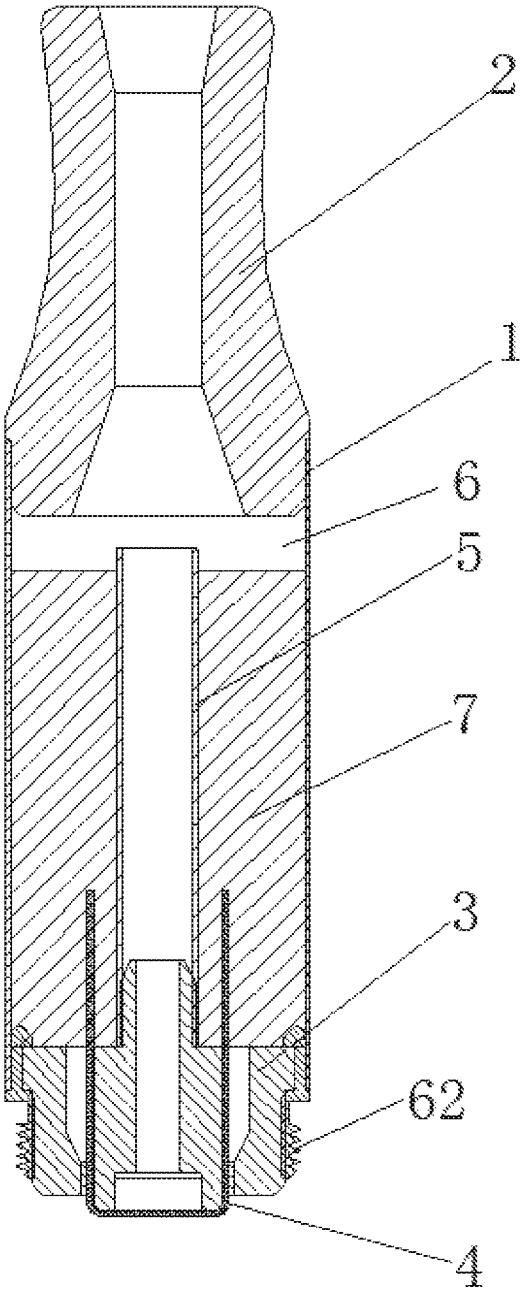
FIG. 3 is a section view of a disposable cigarette cartridge in the embodiment 1.
Figure 4:
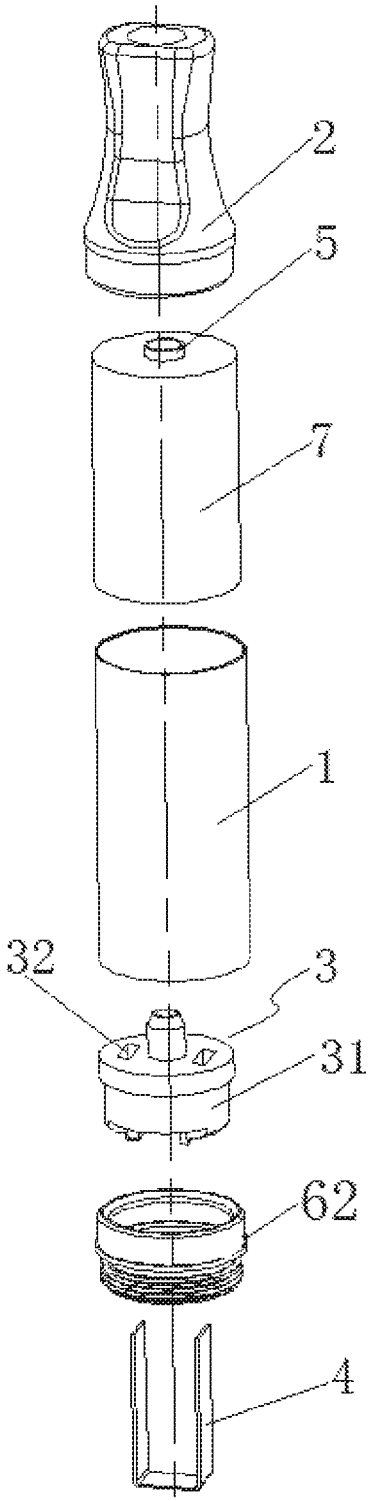
FIG. 4 is an explosive view of the disposable cigarette cartridge in the embodiment 1.
Figure 5:
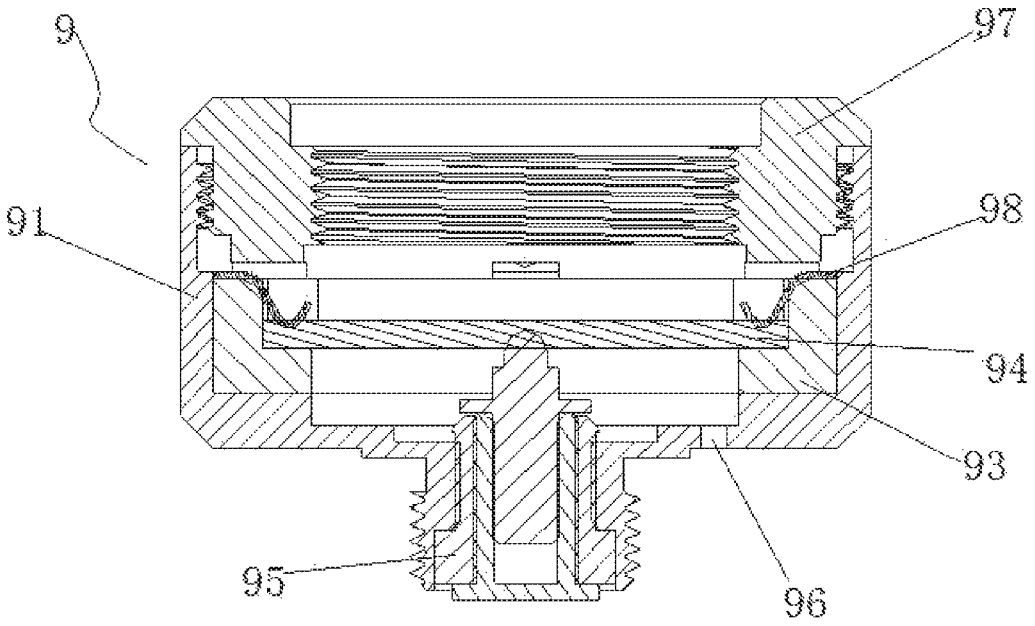
FIG. 5 is a section view of an atomizing core component in the embodiment 1.
Figure 6:
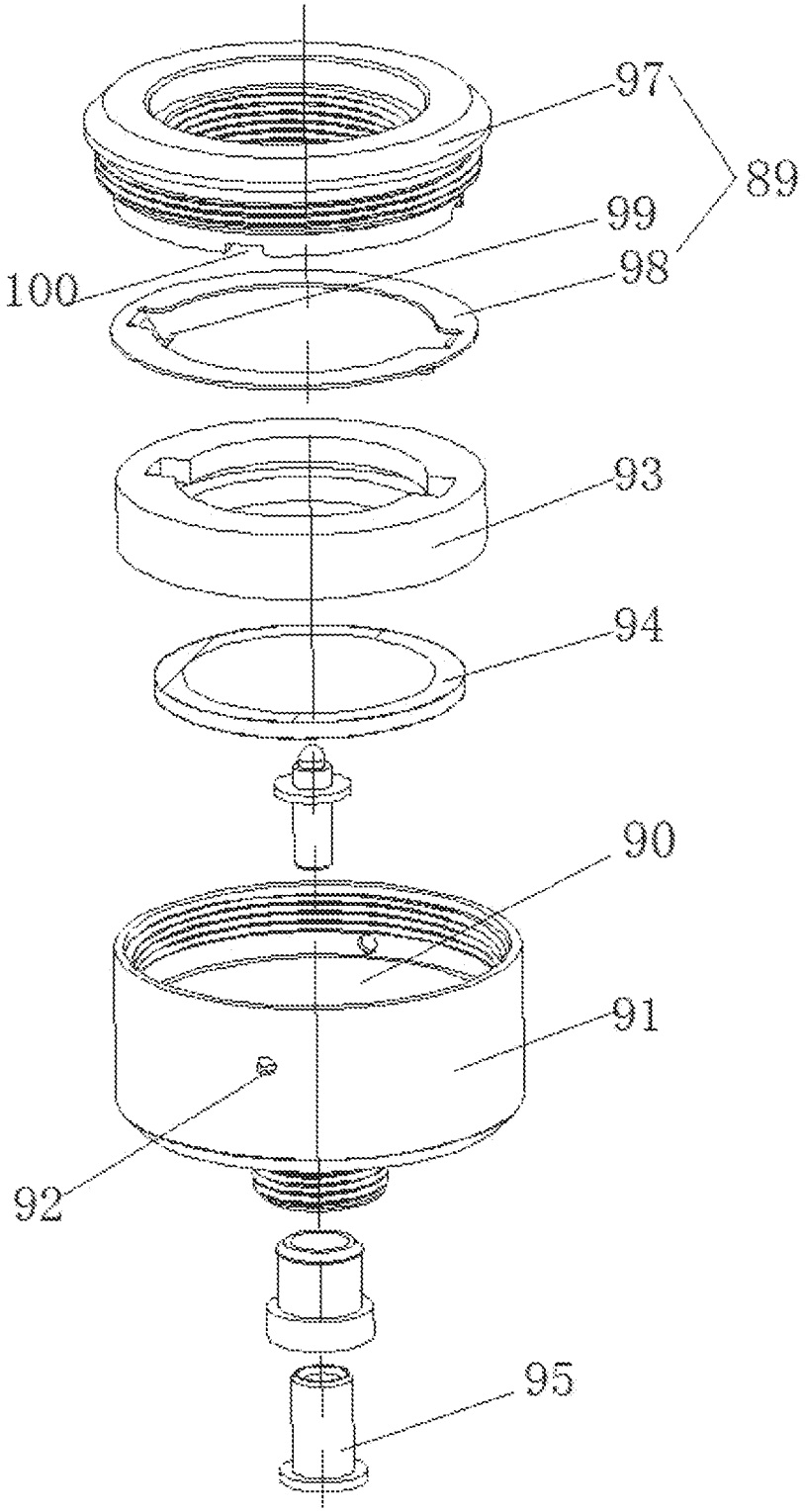
FIG. 6 is an explosive view of the atomizing core component in the embodiment 1.
Figure 7:
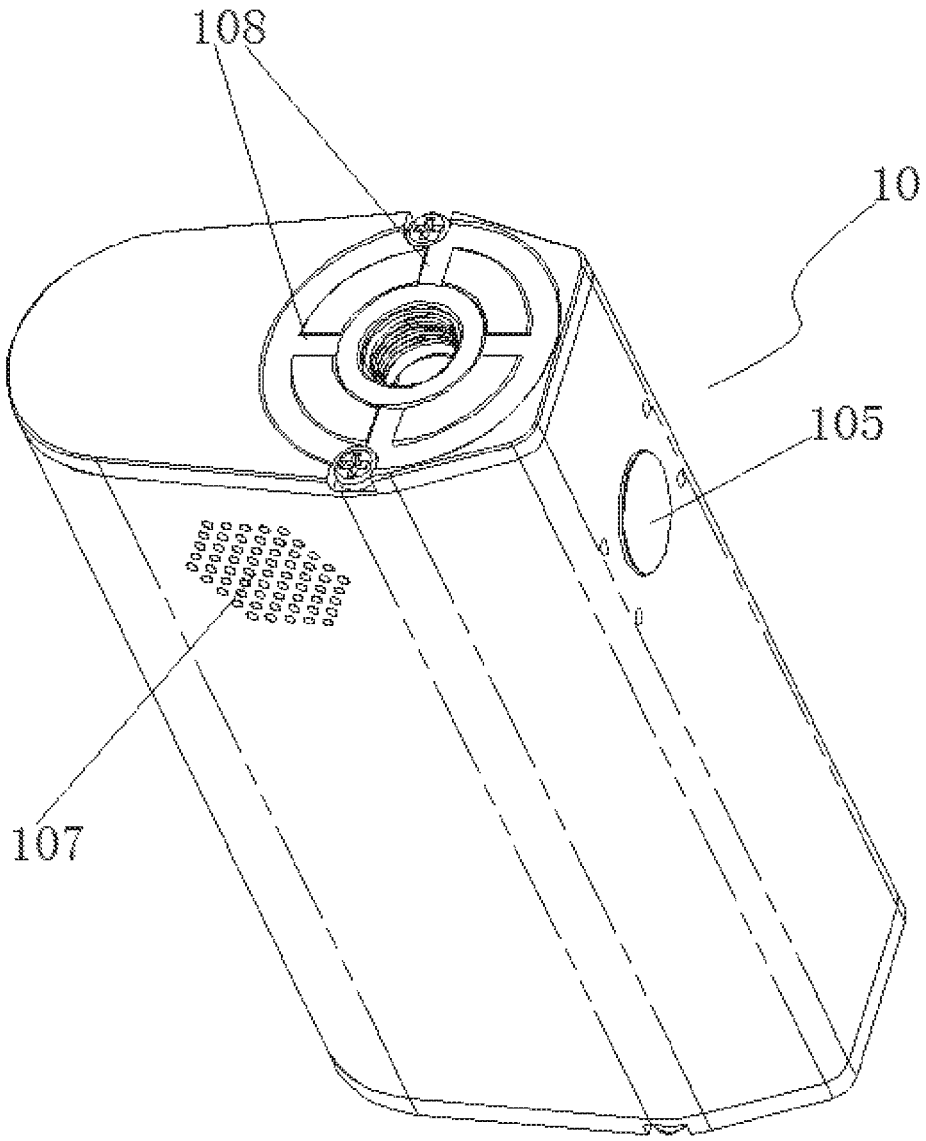
FIG. 7 is a stereogram of a power supply module in the embodiment 1.
Figure 8:
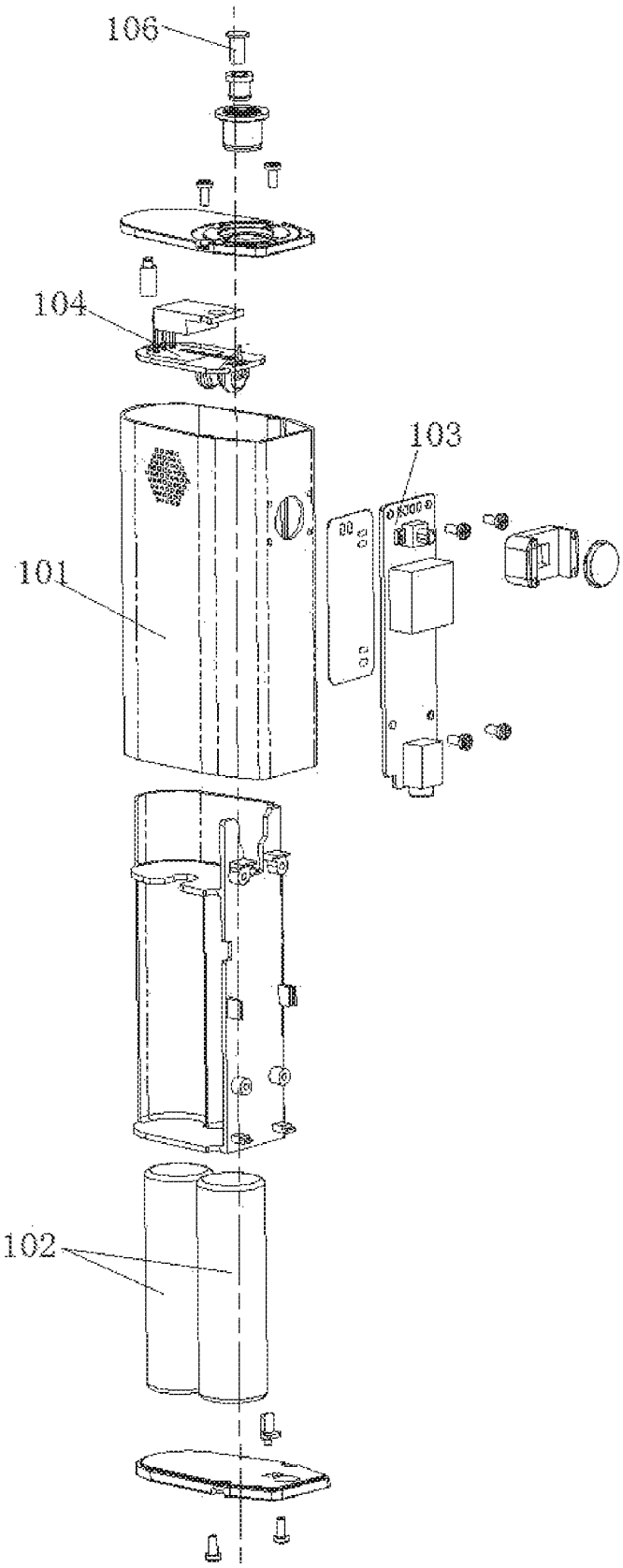
FIG. 8 is an explosive view of the power supply module in the embodiment 1.
Figure 9:
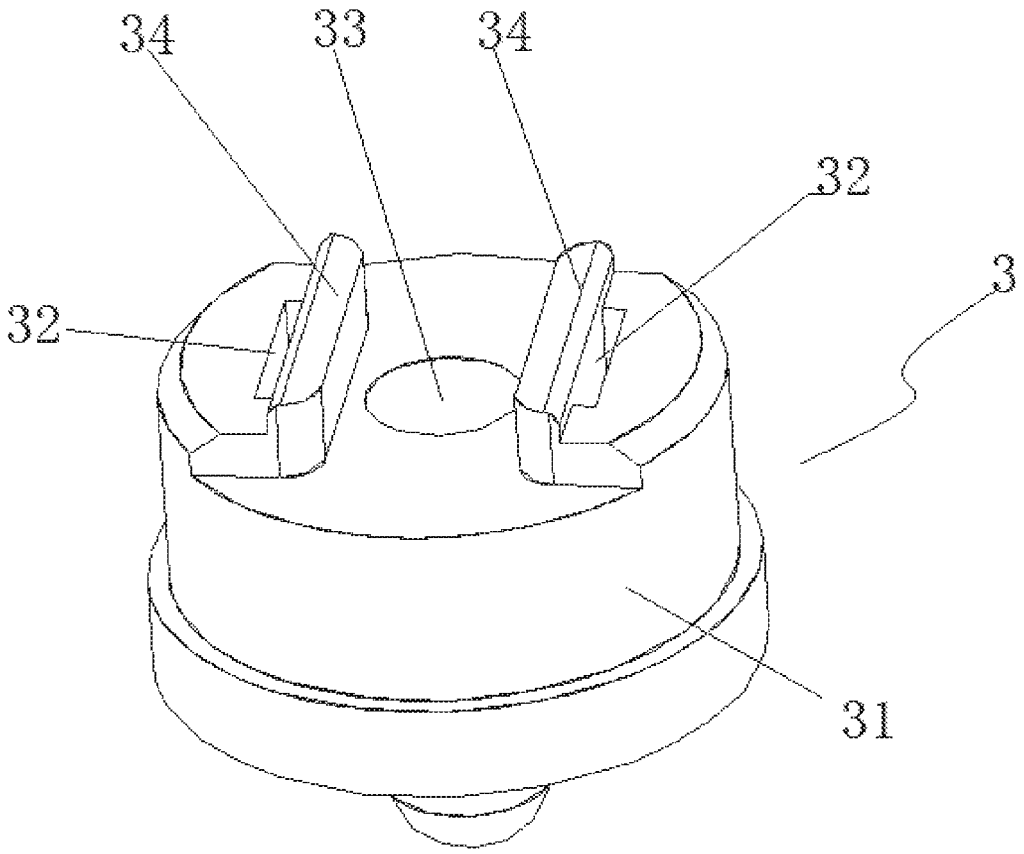
FIG. 9 is a structural diagram of a back surface of a tobacco tar guide seat in the embodiment 1.

1 represents a shell, 2 represents a suction nozzle, 3 represents a tobacco tar guide seat, 4 represents a tobacco tar guide body, 5 represents an air pipe, 6 represents a gap, 7 represents a tobacco tar storage body, 8 represents a tobacco tar cavity, 9 represents an atomizing core component, 10 represents a power supply module, 11 represents a groove, 12 represents a first air outlet hole, 13 represents an air guide sheet, 14 represents a second air inlet passage, 15 represents a third air pass hole, 16 represents a second air outlet hole, 17 represents a first air outlet passage, 18 represents a third air outlet hole, 19 represents a second air outlet passage, 20 represents a third air outlet passage, 21 represents a side hole, 22 represents a suction nozzle seat, 23 represents an indication lamp lampshade, 24 represents a through-hole, 25 represents a cylindrical spring, 31 represents a base, 32 represents a tobacco tar pass hole, 33 represents a vent hole, 34 represents a salient, 35 represents a recessed portion, 41 represents a shell, 42 represents a first gap, 43 represents a second gap, 44 represents a tobacco tar isolation seat, 45 represents tobacco tar guide cotton, 46 represents a third gap, 47 represents a fourth gap, 48 represents a flexible pipe, 50 represents an air inlet, 51 represents a suction nozzle component, 52 represents a tobacco tar cup component, 53 represents an elastic sheet, 54 represents a cotton pressing spring, 55 represents a first air inlet passage, 56 represents a first air pass groove, 57 represents a first air pass hole, 58 represents a tower spring, 59 represents a pressing member, 60 represents an air outlet groove, 61 represents a salient, 62 represents a cigarette cartridge connecting sleeve, 63 represents an electronic cigarette shell, 64 represents a battery bracket, 65 represents a top cover, 66 represents an atomizing seat thread sleeve, 661 represents an air inlet groove, 67 represents a pressing connecting sleeve, 68 represents a fixing seat, 69 represents a heat insulation sleeve, 70 represents a spring terminal, 71 represents an insulating ring, 72 represents an electrode seat, 73 represents a PCB bracket, 74 represents an indicator lamp light guide seat, 89 represents a pressing device, 90 represents a hollow cavity, 91 represents an atomizing core shell, 92 represents an air inlet hole, 93 represents a silica gel seat, 94 represents an ultrasonic atomizing sheet, 95 represents a connecting electrode, 96 represents a heat dissipation hole, 97 represents a pressing seat, 98 represents a conductive sheet, 99 represents a pressing lug, 100 represents a vent groove, 101 represents a power supply shell, 102 represents a battery core, 103 represents a power supply control board, 104 represents an atomizing control board, 105 represents a switch, 106 represents an electrode ring, 107 represents a heat dissipation passage, 108 represents an air guide groove, 131 represents a sheet-like body, 132 represents a second air pass hole, 133 represents a boss, 134 represents a second air pass groove, 141 represents a flange, 142 represents a first air guide hole, 151 represents a second air guide hole, 152 represents a neck, 153 represents a rotating guide rail, 154 represents an in-place prompting convex rib, 331 represents a limiting portion, 441 represents a vertical portion and 442 represents a flange edge.

DETAILED DESCRIPTION OF THE EMBODIMENTS

Embodiment 1

As shown in FIG. 1 to FIG. 9, a disposable cigarette cartridge includes a hollow shell 1, a tobacco tar storage device located in the shell 1, a suction nozzle 2 connected with the upper end of the shell 1, a tobacco tar guide seat 3 connected with the lower end of the shell 1, and a tobacco tar guide body 4 installed on the tobacco tar guide seat 3. The tobacco tar guide seat 3 includes a base 31, and a tobacco tar pass hole 32 which penetrates through the base 31 in the vertical direction. An air passage is arranged in the shell 1, one end of the air passage is communicated with the suction nozzle 2, and the other end of the air passage is communicated with a heating surface of the tobacco tar guide body 4. The air passage includes a vent hole 33 which penetrates through the base 31 in the vertical direction, and an air pipe 5, one end of the air pipe 5 is communicated with the suction nozzle 2, and the other end of the air pipe 5 is communicated with the vent hole 33.

A gap 6 is reserved between the air passage and the lower end of the suction nozzle 2. Two tobacco tar pass holes 32 are formed and are symmetrically distributed on both sides of the vent hole 33. A salient 34 which extends downward and supports the inner side of the tobacco tar guide body 4 is arranged on the edge of one side of each tobacco tar pass hole 32 close to the vent hole 33 on the lower surface of the base 31, salients are symmetric with respect to the vent hole 33.

The tobacco tar storage device is a tobacco tar storage body 7 impregnated with tobacco tar and located in the inner cavity of the shell 1, which is arranged on the upper surface of the tobacco tar guide seat 3. The tobacco tar guide body 4 is inserted from the lower end of the tobacco tar pass hole 32 and penetrates through the upper end of the tobacco tar pass hole 32 until the tobacco tar guide body 4 props against the tobacco tar storage device, and the tobacco tar guide body 4 forms a U-shaped structure.

At the same time, the present embodiment further provides a modular electronic cigarette, including an atomizing core component 9, and a power supply module 10 electrically connected with the lower end of the atomizing core component 9, and the modular electronic cigarette further includes the disposable cigarette cartridge in the above solution which can be detachably connected with the atomizing core component 9, the tobacco tar guide seat 3 is fixed in a cigarette cartridge connecting sleeve 62, and the cigarette cartridge connecting sleeve 62 is connected with the upper end of the atomizing core component 9.

The atomizing core component 9 includes a hollow atomizing core shell 91, an air inlet hole 92 located in the wall of the atomizing core shell 91, a silica gel seat 93 arranged in a hollow cavity 90 of the atomizing core shell 91, an ultrasonic atomizing sheet 94 arranged on the silica gel seat 93, a connecting electrode 95 electrically connected with the ultrasonic atomizing sheet 94, and a pressing device which presses the ultrasonic atomizing sheet 94.

The air inlet hole 92 is communicated with the hollow cavity 90 of the atomizing core shell 91.

The pressing device 89 is detachably connected with the tobacco tar guide seat 3, and after assembly and connection, the tobacco tar guide body 4 props against the atomizing surface of the ultrasonic atomizing sheet 94, and the hollow cavity 90 of the atomizing core shell 91 is communicated with the air passage of the disposable cigarette cartridge.

A heat dissipation hole 96 is formed in the bottom of the atomizing core shell 91, and the heat dissipation hole 96 is communicated with the hollow cavity 90 of the atomization core shell 91.

The pressing device 89 includes a pressing seat 97 connected with the atomizing core shell 91, an annular conductive sheet 98 is arranged between the pressing seat 97 and the silica gel seat 93, a pressing lug 99 is arranged on the conductive sheet 98, and the pressing lug 99 props against the edge of the ultrasonic atomizing sheet 94.

A vent groove 100 is formed in the lower end of the pressing seat 97, and the vent groove 100 is communicated with the air inlet hole 92 and the hollow cavity 90 of the atomizing core shell 91.

The external air enters from the air inlet hole 92, enters the hollow cavity 90 of the atomizing core shell 91 through the vent groove 100, and reaches a contact surface of the tobacco tar guide body 4 and the ultrasonic atomizing sheet 94, and the atomized smoke enters the vent hole 33 from the side face of the tobacco tar guide body 4 of the U-shaped structure and enters the suction nozzle 2 through the air pipe 5.

The power supply module 10 includes a power supply shell 101, a battery core 102 located in the power supply shell 101, a power supply control board 103 and an atomizing control board 104 electrically connected with the battery core 102, and a switch 105 which controls the on-off state of the power supply control board 103.

An electrode ring 106 that can be electrically conductive with the lower end of the atomizing core component 9 is arranged at the top of the power supply shell 101, and the electrode ring 106 is electrically connected with the atomizing control board 104.

A heat dissipation passage 107 is formed in the wall of the power supply shell 101.

An air guide groove 108 is formed at the top of the power supply shell 101, which is in a connection site of the top of the power supply shell 101 and the atomizing core component 9, and the air guide groove 108 is communicated with the heat dissipation hole 96.

Embodiment 2

Figure 10:
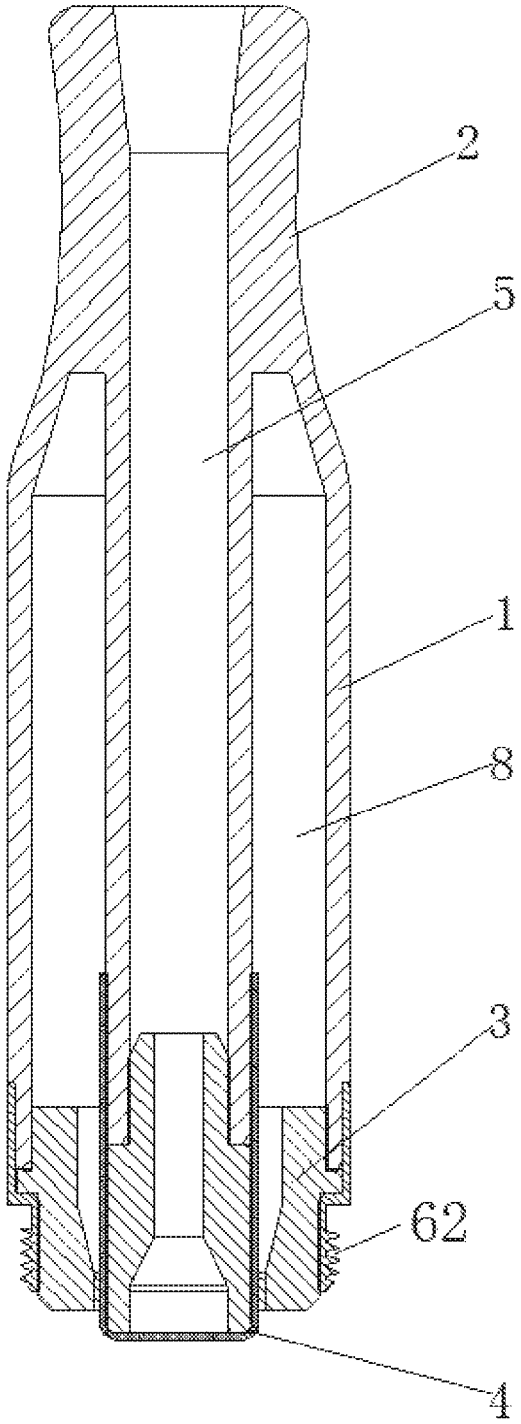
FIG. 10 is a section view of a disposable cigarette cartridge in an embodiment 2.
Figure 11:
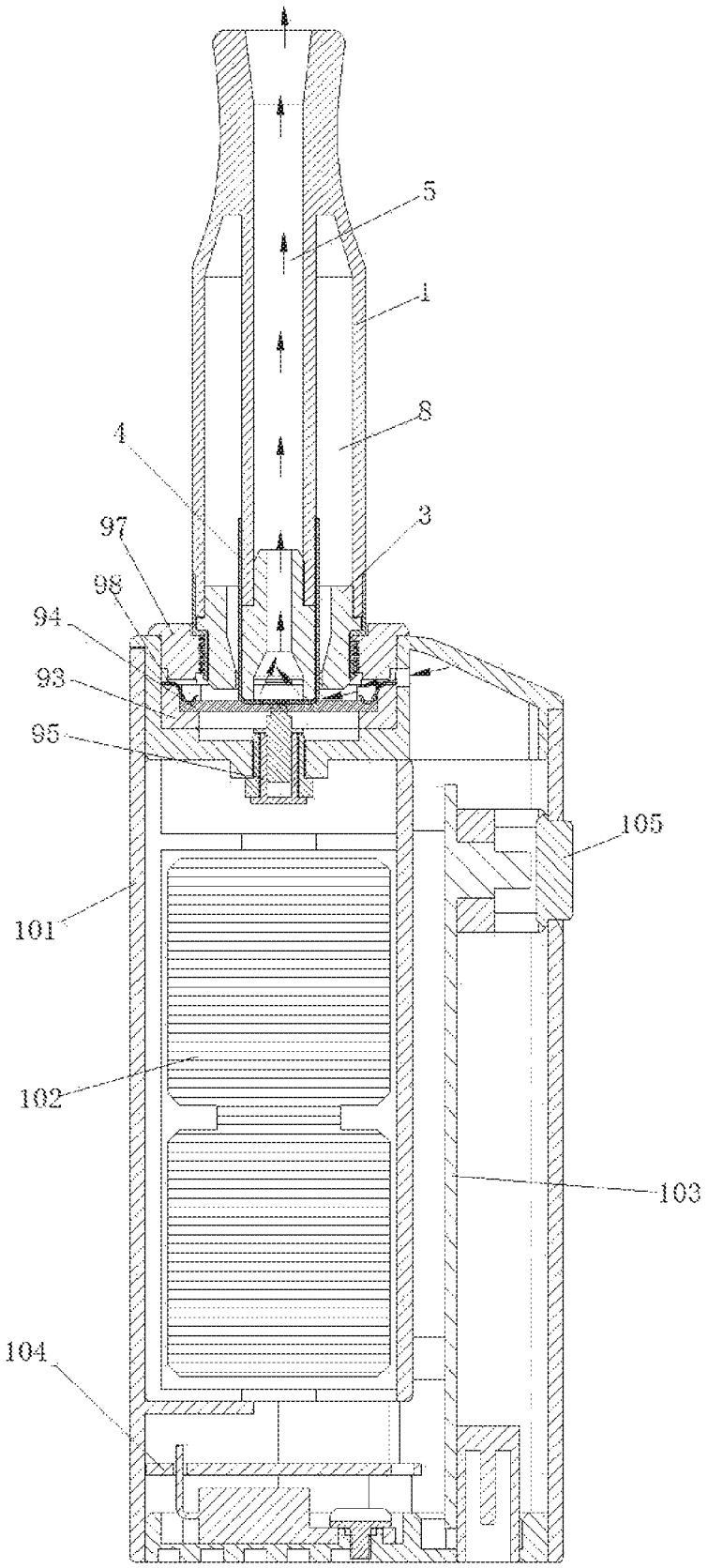
FIG. 11 is a section view of an electronic cigarette in the embodiment 2.
Figure 12:
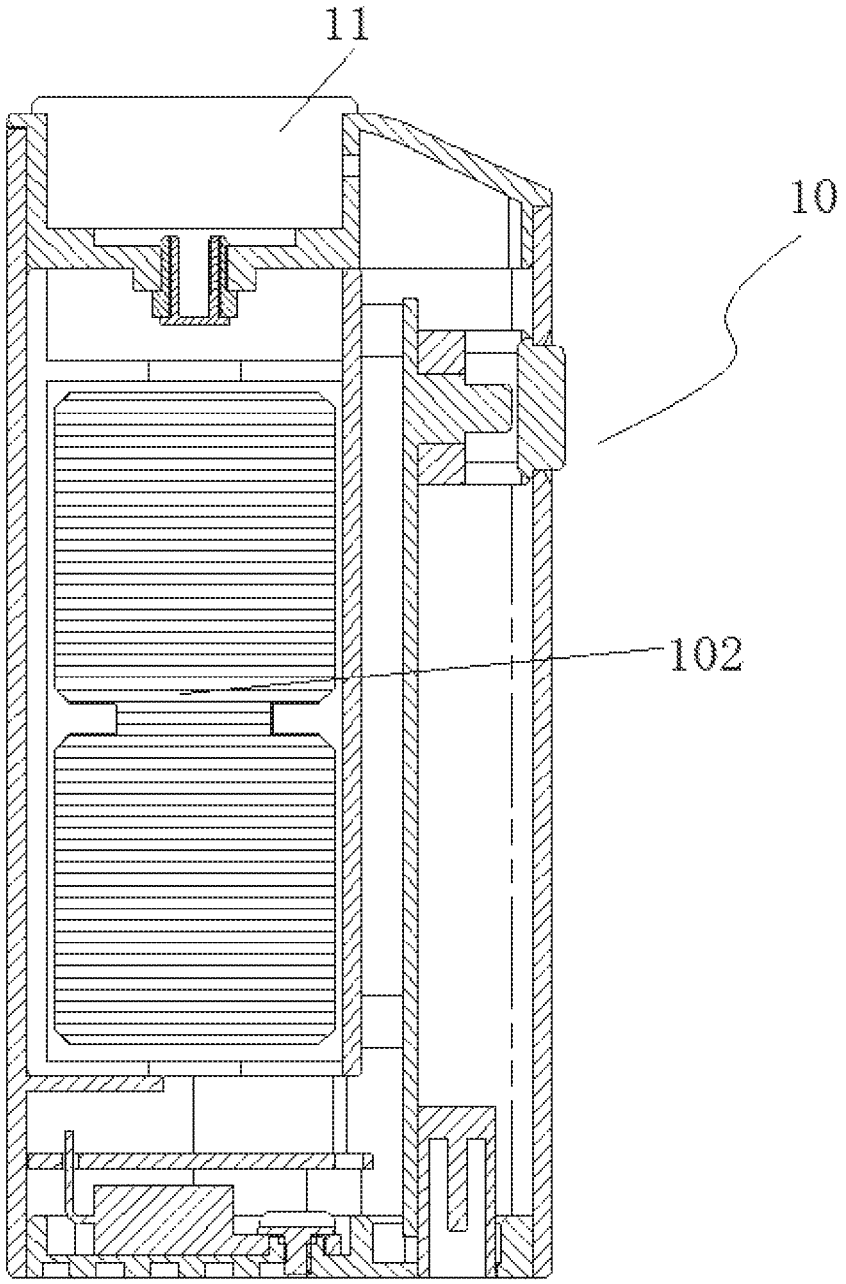
FIG. 12 is a section view of a power supply module in the embodiment 2.
Figure 13:
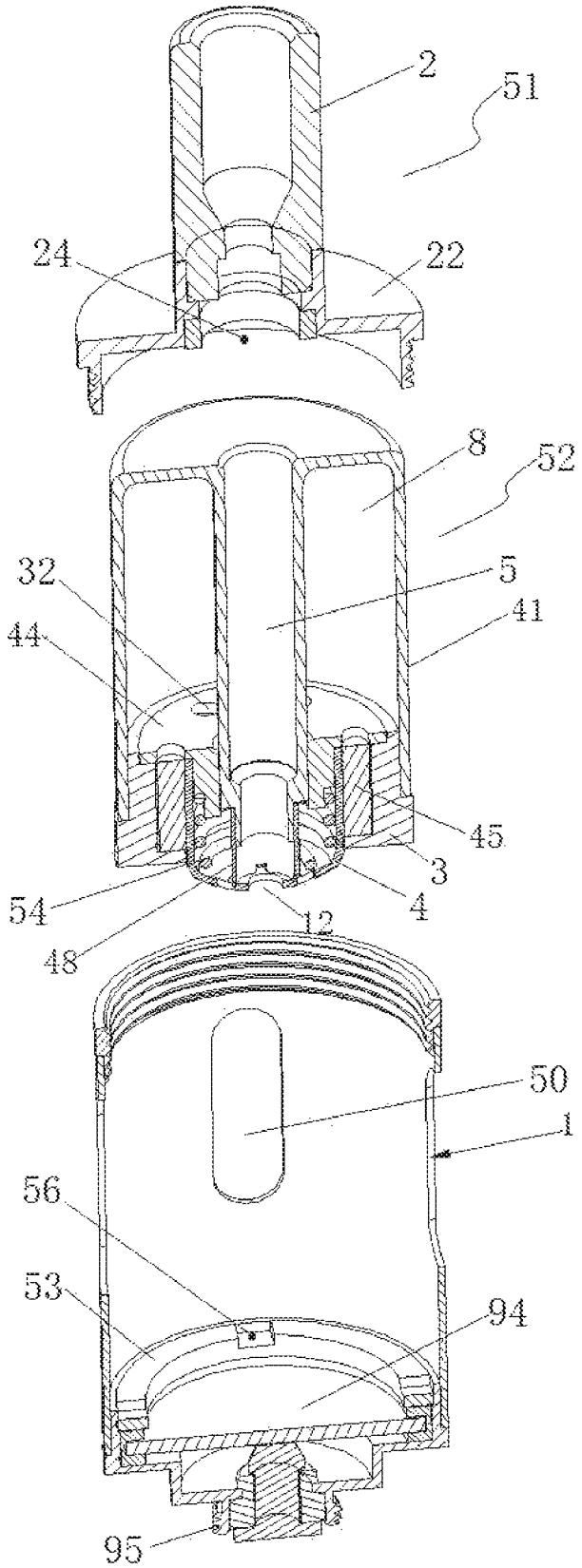
FIG. 13 is an oblique dissection explosive view of an atomizer in an embodiment 3.
Figure 14:
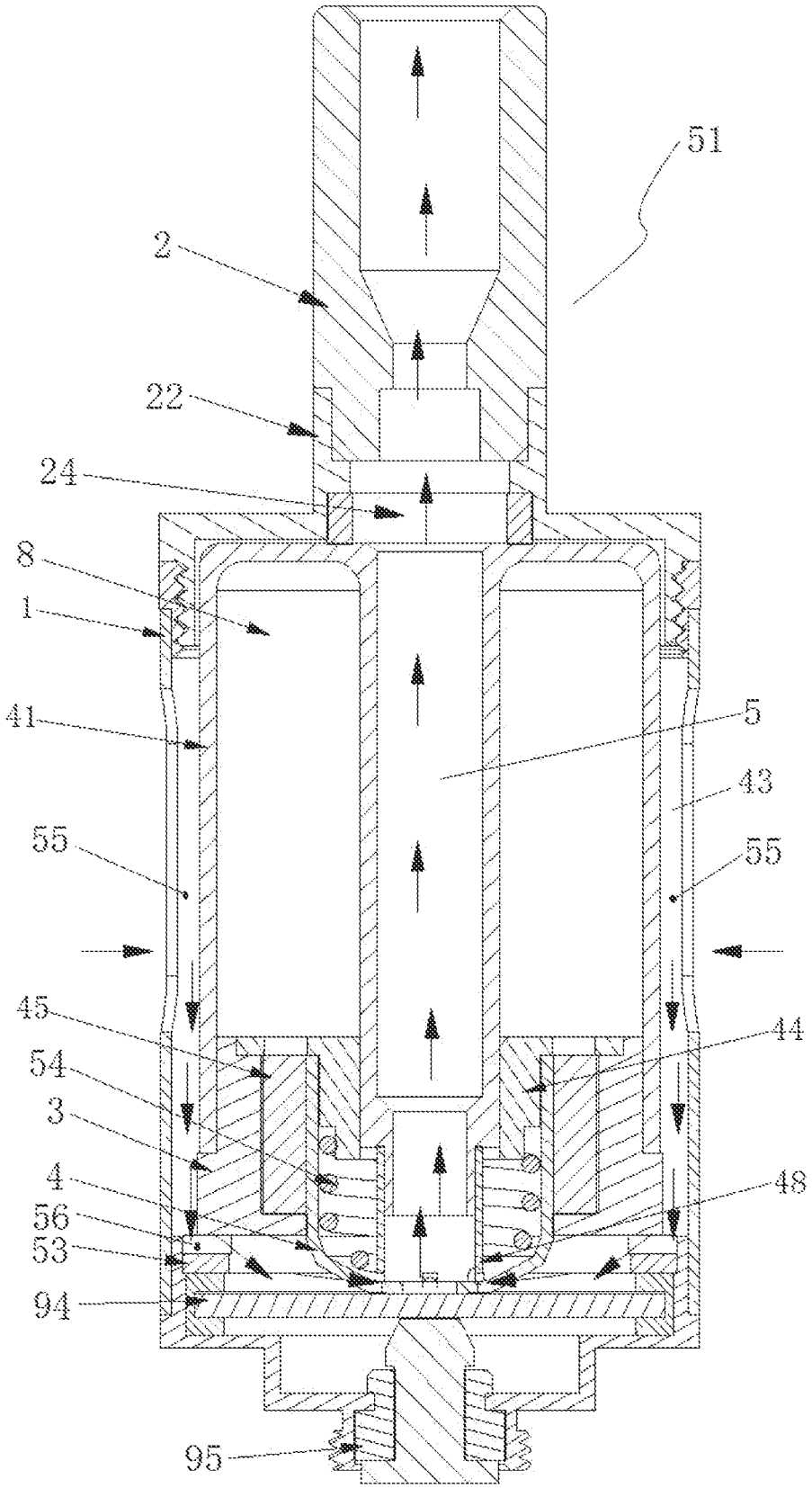
FIG. 14 is a section view of the embodiment 3.
Figure 15:
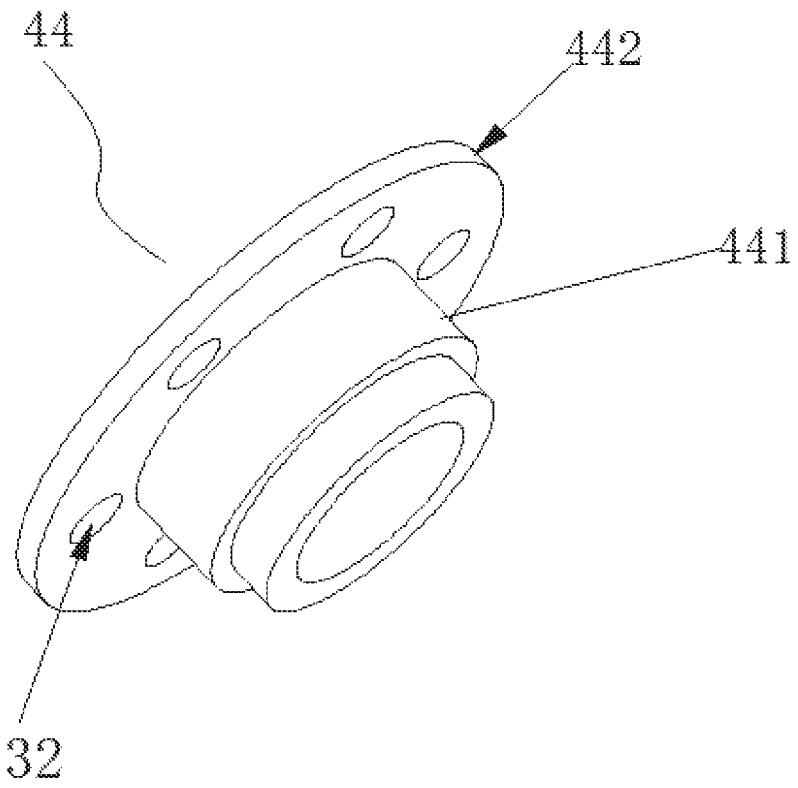
FIG. 15 is a structural diagram of a tobacco tar isolation seat in the embodiment 3.
Figure 16:
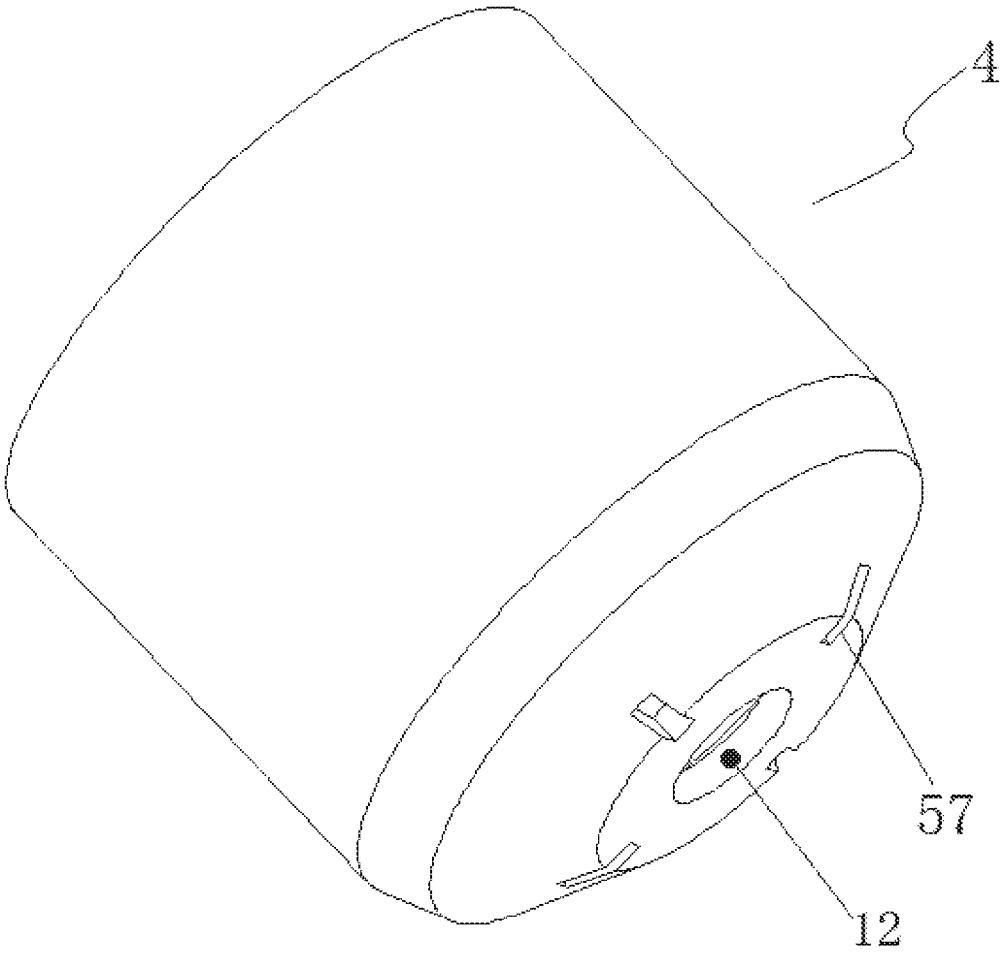
FIG. 16 is a structural diagram of a tobacco tar guide body in the embodiment 3.
Figure 17:
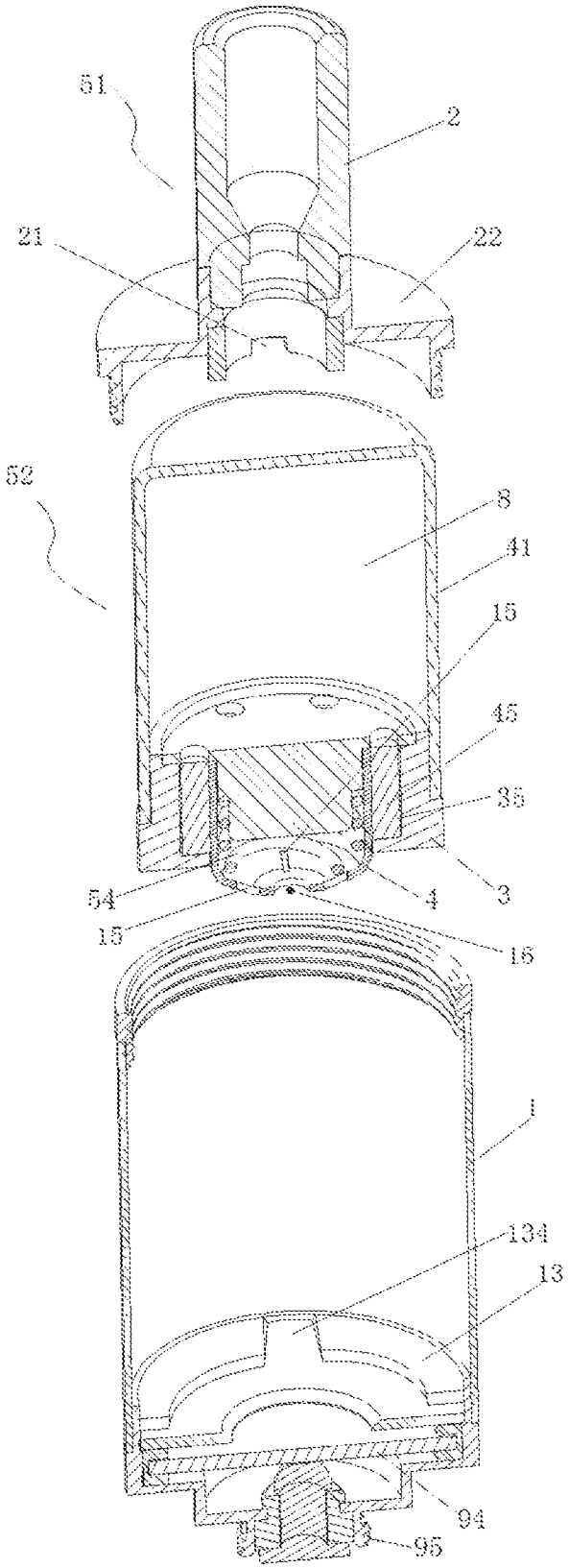
FIG. 17 is an oblique dissection explosive view of an atomizer in an embodiment 4.
Figure 18:
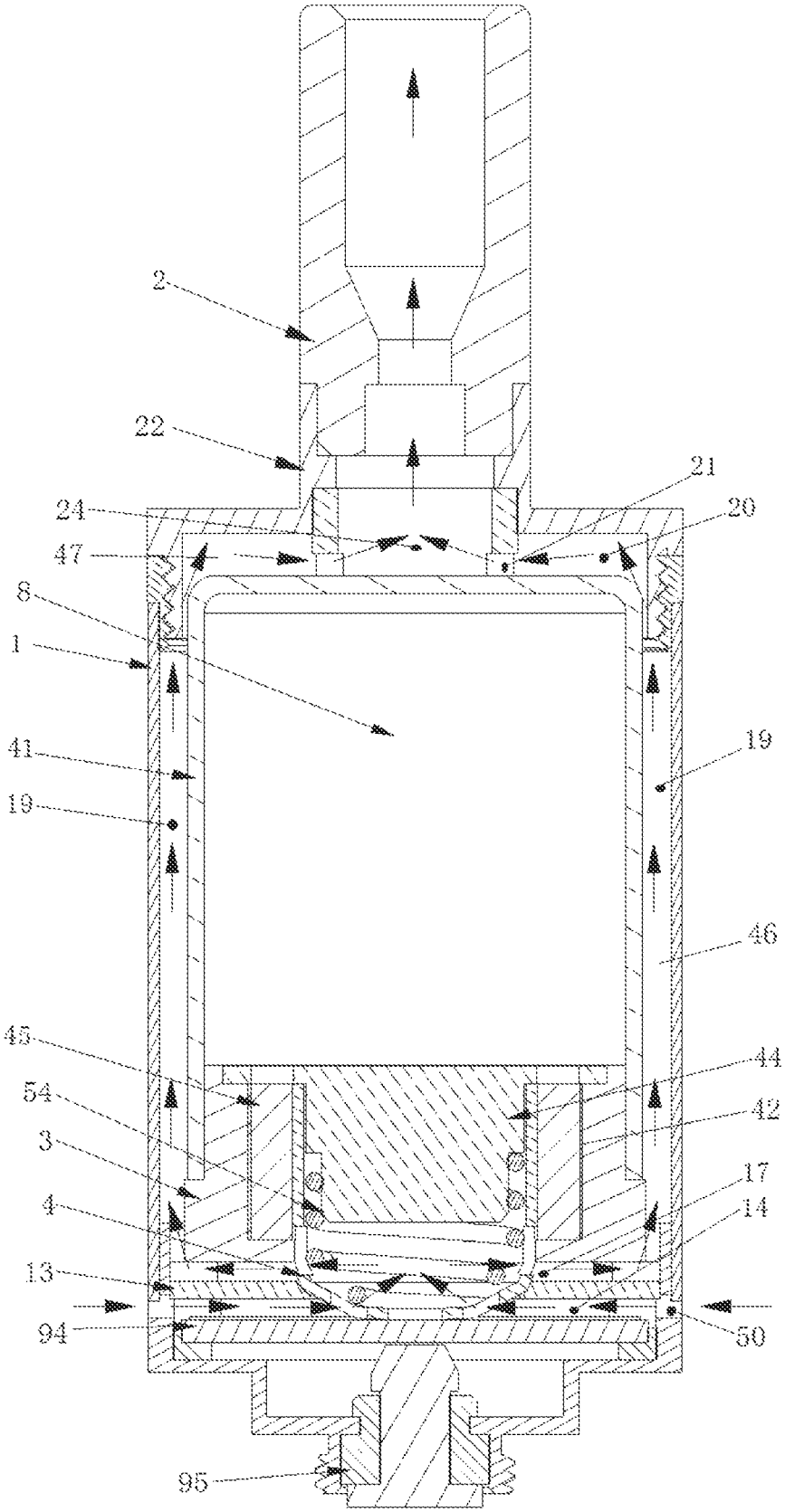
FIG. 18 is a section view of the embodiment 4.
Figure 19:
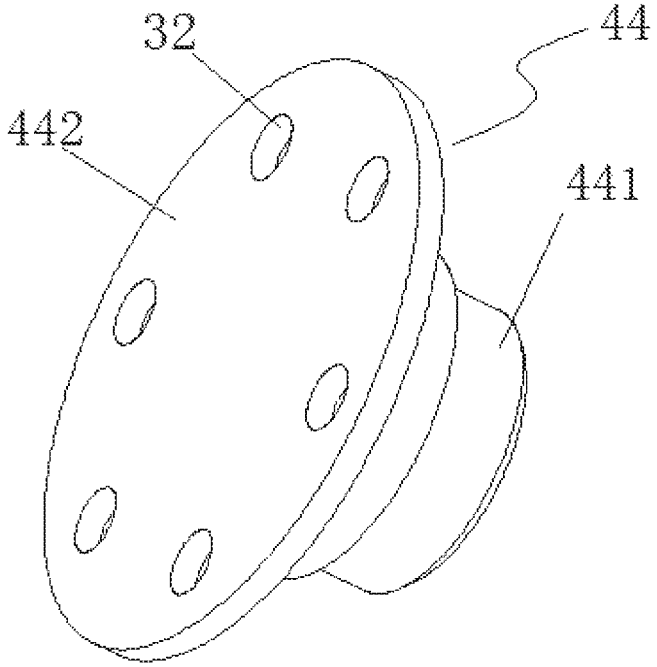
FIG. 19 is a structural diagram of a tobacco tar isolation seat in the embodiment 4.
Figure 20:
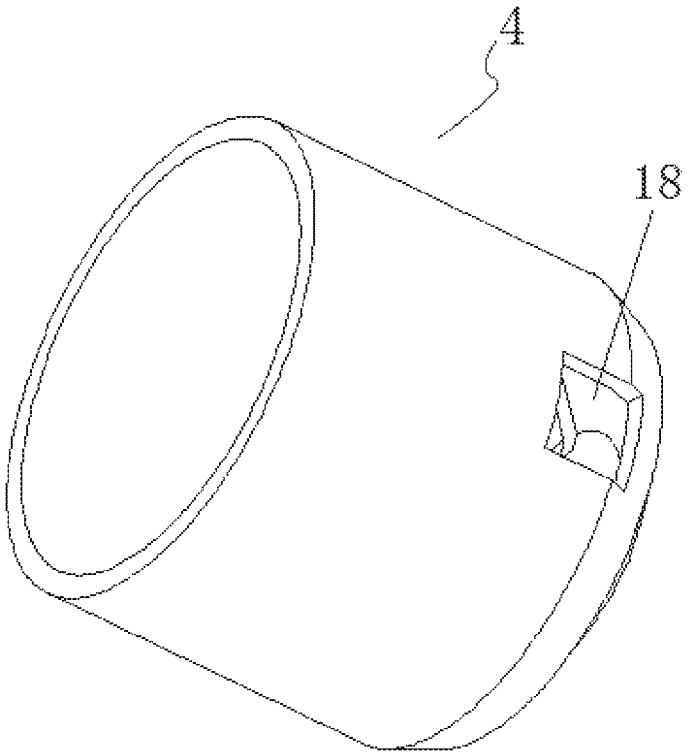
FIG. 20 is a structural diagram of a tobacco tar guide body in the embodiment 4.
Figure 21:
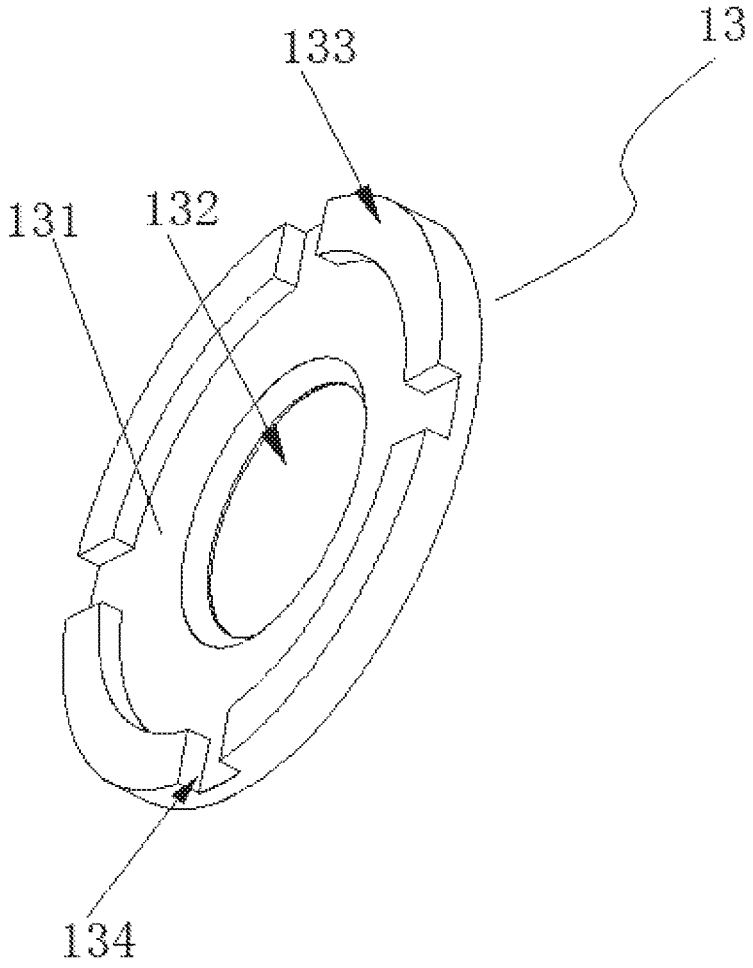
FIG. 21 is a structural diagram of an air guide sheet.
Figure 22:
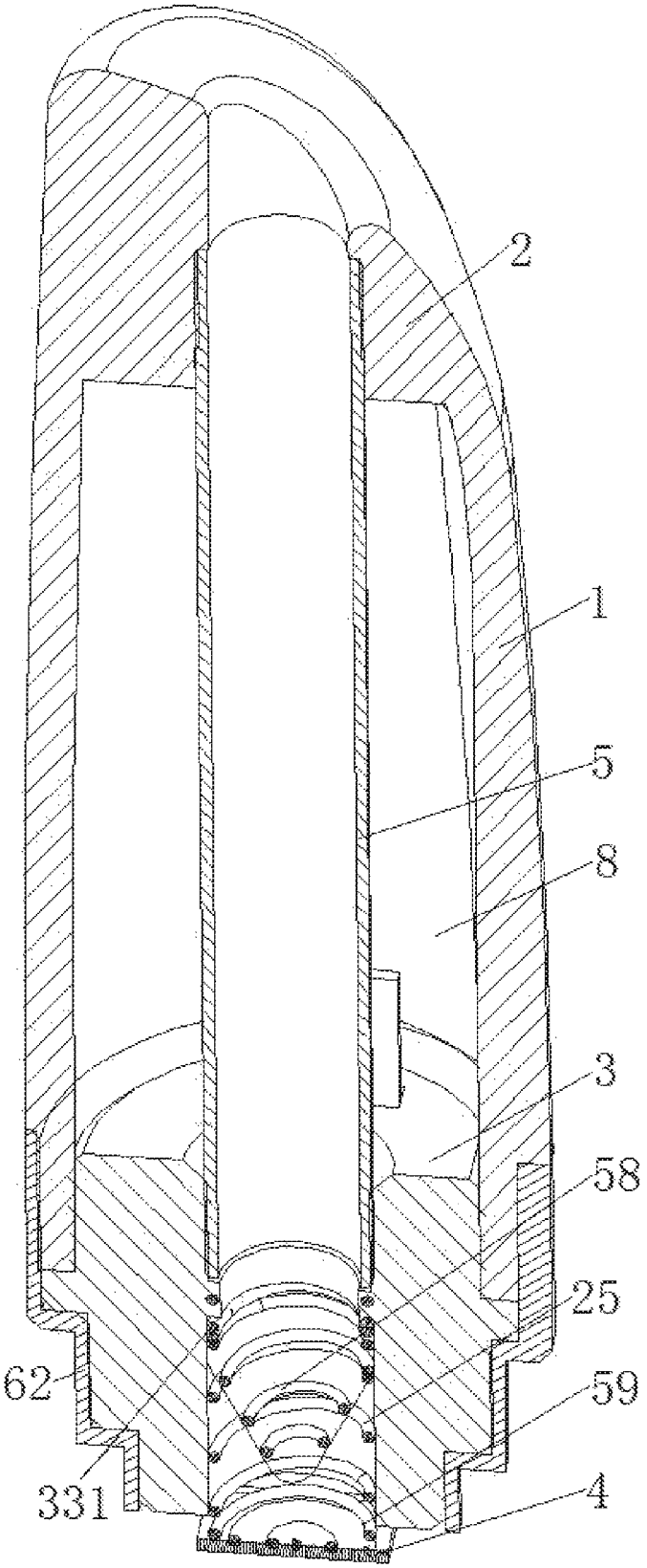
FIG. 22 is a structural schematic diagram of an embodiment 5 of a cigarette cartridge.

As shown in FIG. 10 to FIG. 12, the embodiment 1 is repeated, the difference lies in that: the tobacco tar storage device is a tobacco tar cavity 8 arranged in the shell 1, and the tobacco tar cavity is filled with tobacco tar.

A groove 11 is formed in the top of the power supply module 10, the atomizing core component 9 is arranged in the groove 11, and the top of the atomizing core component 9 is flush with the top of the power supply module 10.

The structure in which the atomizing core component 9 is built in the power supply module 10 is smaller in volume and is convenient to assemble and carry.

Embodiment 3

As shown in FIG. 13 to FIG. 16, the atomizer includes a shell 1, an air inlet 50, a suction nozzle component 51 installed at the top of the shell 1, an ultrasonic atomizing sheet 94 arranged in the shell 1, and a connecting electrode installed at the bottom of the shell 1. A tobacco tar cup component 52 which props against the ultrasonic atomizing sheet 94 is arranged in the shell 1, the tobacco tar cup component 52 includes a tobacco tar cup shell 41, a tobacco tar cavity 8 located in the tobacco tar cup shell 41, and a tobacco tar guide body 4 capable of guiding the tobacco tar in the tobacco tar cavity 8 into the atomizing surface of the ultrasonic atomizing sheet 94, and the tobacco tar guide body 4 props against the ultrasonic atomizing sheet 94.

The bottom of the tobacco tar cup shell 41 of the tobacco tar cup component 52 is sealed by the tobacco tar guide seat 3, a recessed portion is arranged at the middle of the tobacco tar guide seat 3, and a tobacco tar isolation seat 44 is installed in the recessed portion. The tobacco tar isolation seat 44 is T-shaped and includes a vertical portion 441 and a flange edge 442 located at the top of the vertical portion 441, the vertical portion 441 is inserted into the recessed portion, a first gap 42 is reserved between the vertical portion and the inner wall of the recessed portion, the tobacco tar guide cotton 45 is arranged in the first gap 42, and a tobacco tar pass hole 32 communicated with the tobacco tar cavity 8 is formed in a position corresponding to the tobacco tar guide cotton 45 on the flange edge 442.

The outer wall of the vertical portion 441 is wrapped with the tobacco tar guide body 4, the side face of the tobacco tar guide body 4 props against the tobacco tar guide cotton 45, and the bottom of the tobacco tar guide body 4 props against the ultrasonic atomizing sheet 94.

A cotton pressing spring 54 is sleeved on the lower end of the vertical portion 441, the cotton pressing spring 54 is wrapped by the tobacco tar guide body 4, and the lower end of the cotton pressing spring 54 props against the inner surface of the bottom of the tobacco tar guide body 4.

An air inlet passage communicated with the air inlet 50 is formed in the shell 1, and the air inlet passage extends to the atomizing surface of the ultrasonic atomizing sheet 94; and an air outlet passage communicated with the suction nozzle component 51 is arranged in the shell 1.

A second gap 43 is reserved between the outer wall of the tobacco tar cup shell 41 of the tobacco tar cup component 52 and the inner wall of the shell 1, and the second gap 43 forms a first air inlet passage 55.

An elastic sheet 53 is arranged around the edge of the ultrasonic atomizing sheet 94, a first air pass groove 56 communicated with the first air inlet passage 55 is formed in the elastic sheet 53, and the first air pass groove 56 is communicated with the atomizing surface of the ultrasonic atomizing sheet 94.

A first air pass hole 57 communicated with the first air inlet passage 55 is formed in the lower part of the tobacco tar guide body 4, and a first air outlet hole 12 is formed in the bottom of the tobacco tar guide body 4.

The air outlet passage includes an air pipe 5 located in the tobacco tar cup component 52, one end of the air pipe 5 is communicated with the suction nozzle component 51, and the other end of the air pipe penetrates through the tobacco tar isolation seat 44, is inserted into a center hole of the cotton pressing spring 54 and is communicated with the first air outlet hole 12.

A segment of flexible pipe 48 is arranged between the air pipe 5 and the first air outlet hole 12, and one end of the flexible pipe 48 props against the inner bottom surface of the tobacco tar guide body 4 and is communicated with the first air outlet hole 12; and the other end of the flexible pipe is sleeved with the air pipe 5.

The suction nozzle component 51 includes a suction nozzle seat 22 and a suction nozzle 2 installed on the suction nozzle seat 22, a through-hole 24 communicated with the suction nozzle 2 is formed in the suction nozzle seat 22, and the through-hole 24 is communicated with the air pipe 5. The suction nozzle seat 22 is detachably connected with the top of the shell 1. The tobacco tar cup component 52 is detachably connected with the shell 1.

Preferably, the shell of the tobacco tar cup component 52 is made of a transparent material, the air inlet 50 is arranged at a position corresponding to the tobacco tar cup shell 41 on the side wall of the shell 1, and the length of the air inlet 50 is equal to the height of the tobacco tar cavity 8.

The ultrasonic atomizing sheet 94 is electrically connected with the connecting electrode 95.

The electronic cigarette in the embodiment 3 further includes an external power supply and the atomizer, and the external power supply is connected with the connecting electrode 95 of the atomizer.

Embodiment 4

As shown in FIG. 17 to FIG. 21, the atomizer includes a shell 1, an air inlet 50, a suction nozzle component 51 installed at the top of the shell 1, an ultrasonic atomizing sheet 94 arranged in the shell 1, and a connecting electrode installed at the bottom of the shell 1. A tobacco tar cup component 52 which props against the ultrasonic atomizing sheet 94 is arranged in the shell 1, the tobacco tar cup component 52 includes a sealed tobacco tar cup shell 41, a tobacco tar cavity 8 located in the tobacco tar cup shell 41, and a tobacco tar guide body 4 capable of guiding the tobacco tar in the tobacco tar cavity 8 into the atomizing surface of the ultrasonic atomizing sheet 94, and the tobacco tar guide body 4 props against the ultrasonic atomizing sheet 94.

The bottom of the tobacco tar cup shell 41 of the tobacco tar cup component 52 is sealed by the tobacco tar guide seat 3, a recessed portion 35 is arranged at the middle of the tobacco tar guide seat 3, and a tobacco tar isolation seat 44 is installed in the recessed portion 35. The tobacco tar isolation seat 44 is T-shaped and includes a vertical portion 441 and a flange edge 442 located at the top of the vertical portion 441, the vertical portion 441 is inserted into the recessed portion 35, a first gap 42 is reserved between the vertical portion and the inner wall of the recessed portion 35, the tobacco tar guide cotton 45 is arranged in the first gap 42, and a tobacco tar pass hole 32 communicated with the tobacco tar cavity 8 is formed in a position corresponding to the tobacco tar guide cotton 45 on the flange edge 442.

The outer wall of the vertical portion 441 is wrapped with the tobacco tar guide body 4, the side face of the tobacco tar guide body 4 props against the tobacco tar guide cotton 45, and the bottom of the tobacco tar guide body 4 props against the ultrasonic atomizing sheet 94.

A cotton pressing spring 54 is sleeved on the lower end of the vertical portion 441, the cotton pressing spring 54 is wrapped by the tobacco tar guide body 4, and the lower end of the cotton pressing spring 54 props against the inner surface of the bottom of the tobacco tar guide body 4.

An air inlet passage communicated with the air inlet 50 is formed in the shell 1, and the air inlet passage extends to the atomizing surface of the ultrasonic atomizing sheet 94; and an air outlet passage communicated with the suction nozzle component 51 is arranged in the shell 1.

The air inlet 50 is arranged at a position aligned to the ultrasonic atomizing sheet 94 in the wall of the shell 1, and a flexible air guide sheet 13 is arranged above the ultrasonic atomizing sheet 94. The air guide sheet includes a sheet-like body 131, a second air pass hole 132 located at the middle of the sheet-like body 131, and a boss 133 arranged around the edge of the sheet-like body 131, and a second air pass groove 134 is formed in the boss 133.

A second air inlet passage 14 is formed between the air guide sheet 13 and the ultrasonic atomizing sheet 94, a third air pass hole 15 communicated with the second air inlet passage 14 is formed in the lower part of the tobacco tar guide body 4, and a second air outlet hole 16 is formed in the bottom of the tobacco tar guide body 4.

The tobacco tar guide seat 3 of the tobacco tar cup component 52 props against the boss 133 of the air guide sheet 13, and a first air outlet passage 17 is formed between the bottom of the tobacco tar guide seat 3 and the sheet-like body 131.

A third air outlet hole 18 is formed in a position aligned to the first air outlet passage 17 on the side face of the tobacco tar guide body 4.

A third gap 46 is reserved between the outer wall of the tobacco tar cup shell 41 of the tobacco tar cup component 52 and the inner wall of the shell 1, the third gap 46 forms a second air outlet passage 19, and the second air outlet passage 19 is communicated with the first air outlet passage 17.

A fourth gap 47 is reserved between the suction nozzle component 51 and the top of the tobacco tar cup shell 41 of the tobacco tar cup component 52, the fourth gap 47 forms a third air outlet passage 20, and the third air outlet passage 20 is communicated with the second air outlet passage 19 and the suction nozzle component 51.

The suction nozzle component 51 includes a suction nozzle seat 22 and a suction nozzle 2 installed on the suction nozzle seat 22, and a through-hole 24 communicated with the suction nozzle 2 is formed in the suction nozzle seat 22. A side hole 21 communicated with the third air outlet passage 20 is formed in the side edge of the suction nozzle seat 22. The suction nozzle seat 22 is detachably connected with the top of the shell 1. The tobacco tar cup component 52 is detachably connected with the shell 1.

The ultrasonic atomizing sheet 94 is electrically connected with the connecting electrode 95.

The electronic cigarette in the embodiment 4 further includes an external power supply and the atomizer, and the external power supply is connected with the connecting electrode 95 of the atomizer.

Embodiment 5

As shown in FIG. 22 to FIG. 27, a tobacco tar bead blocking structure for an ultrasonic atomizing electronic cigarette includes a funnel-shaped tower spring 58, a pitch value of the tower spring 58 is less than or equal to a line diameter value of the tower spring 58, the tower spring 58 is located on one side where the atomizing surface of the ultrasonic atomizing sheet 94 is located, and a center line of the tower spring 58 is vertical to the ultrasonic atomizing sheet 94.

The tobacco tar bead blocking structure further includes a pressing member 59 fixedly arranged at the bottom of the tower spring 58, an air outlet groove 60 is formed in the pressing member 59, and the pressing member 59 props against the atomizing surface of the ultrasonic atomizing sheet 94. The pressing member 59 is a non-contact planar spiral spring that is vertical to the tower spring 58. The spacing of the non-contact planar spiral spring is greater than a multiple line diameter of the non-contact planar spiral spring.

The tower spring 58 is fixedly connected with the pressing member 59 through a cylindrical spring 25 which is coaxial with the tower spring 58, the top of the tower spring 58 is connected with the top of the cylindrical spring 25, the bottom of the cylindrical spring 25 is integrally formed with the non-contact planar spiral spring, and the diameters of the coils of the tower spring 58 decrease progressively from top to bottom.

The cigarette cartridge in the embodiment 5 includes the tobacco tar guide body 4 and adopts the tobacco tar bead blocking structure, the tobacco tar bead blocking structure props against one surface of the tobacco tar guide body 4 away from the ultrasonic atomizing sheet 94, and the center line of the tower spring 58 is vertical to the ultrasonic atomizing sheet 94.

The cigarette cartridge further includes a hollow suction nozzle 2 and an air pipe 5, a cigarette cartridge connecting sleeve 62 is connected to the bottom of the side wall of the suction nozzle 2, a tobacco tar guide seat 3 is arranged in the cigarette cartridge connecting sleeve 62, the tobacco tar guide body 4 is a U-shaped tobacco tar guide cotton sheet, the tobacco tar cavity 8 which accommodates the tobacco tar is enclosed among the tobacco tar guide seat 3, the suction nozzle 2 and the air pipe 5, the bottom surface of the tobacco tar guide body 4 is located below the tobacco tar guide seat 3, and the two side walls of the tobacco tar guide body 4 are communicated with the tobacco tar cavity 8 through the tobacco tar pass hole 32 in the tobacco tar guide seat 3; a vertical vent hole 33 is formed in the tobacco tar guide seat 3, and the vent hole 33 is communicated with the outside through the air pipe 5; and when the tobacco tar bead blocking structure is adopted, a limiting portion 331 which props against the top end of the cylindrical spring 25 is arranged on the side wall of the vent hole 33, and the non-contact planar spiral spring props against the inner bottom surface of the tobacco tar guide body 4.

Figure 23:
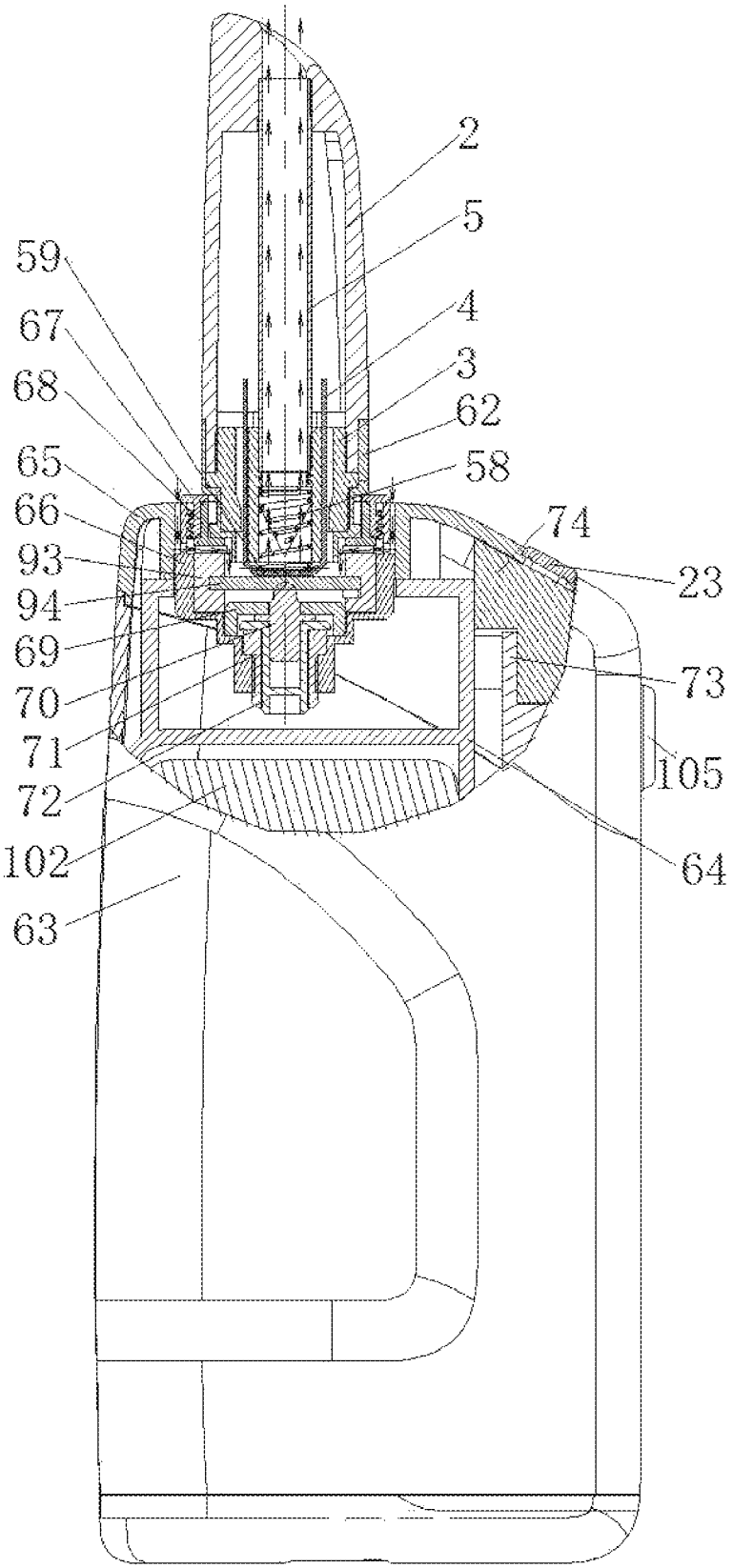
FIG. 23 is a structural schematic diagram of the embodiment 5 of an electronic cigarette.
Figure 24:
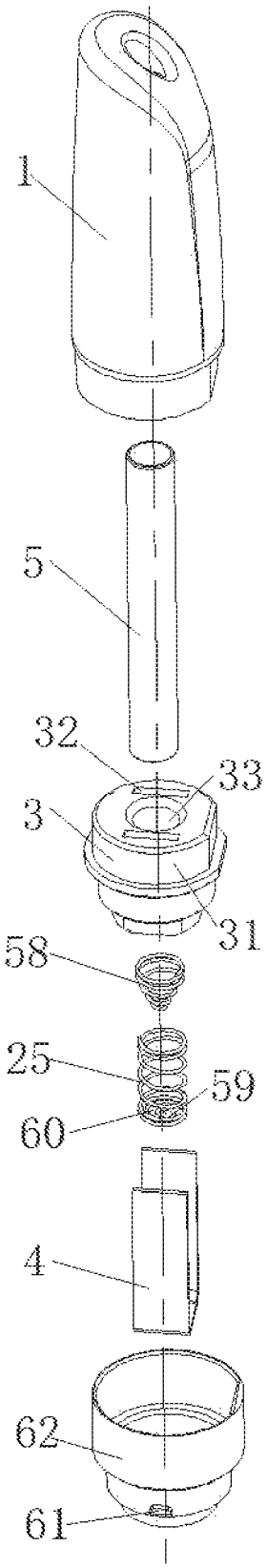
FIG. 24 and FIG. 25 constitute an explosive view of the embodiment 5 of the electronic cigarette.
Figure 25:
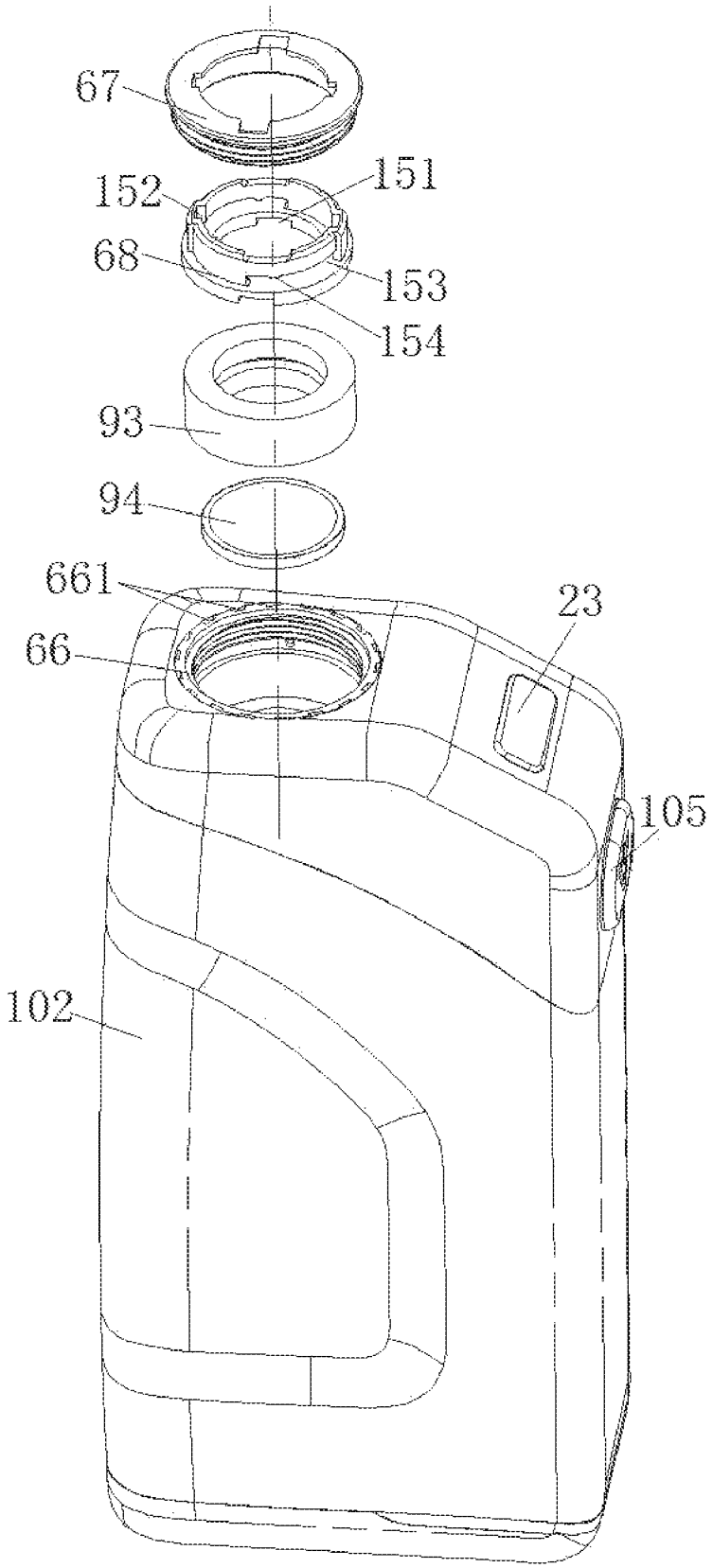
Figure 26:
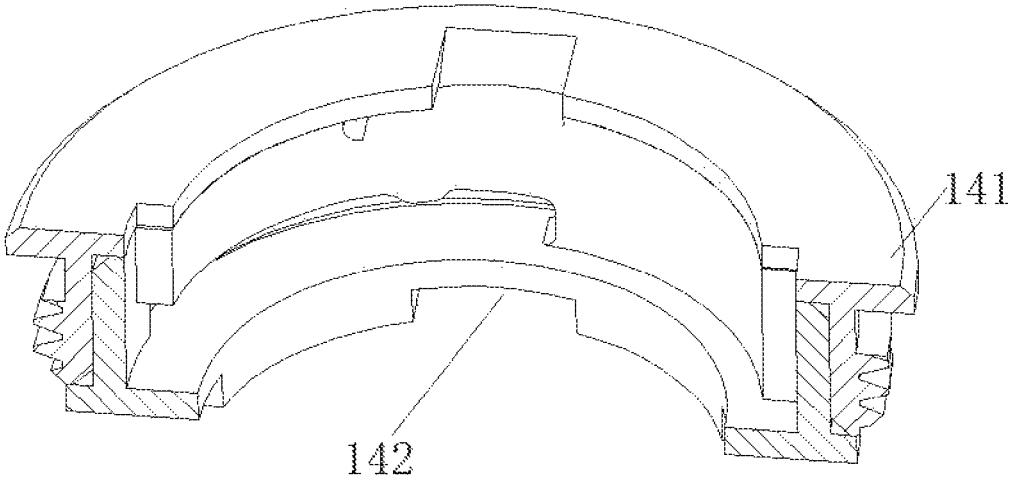
FIG. 26 is an oblique section view of a pressing connecting sleeve in the embodiment 5.
Figure 27:
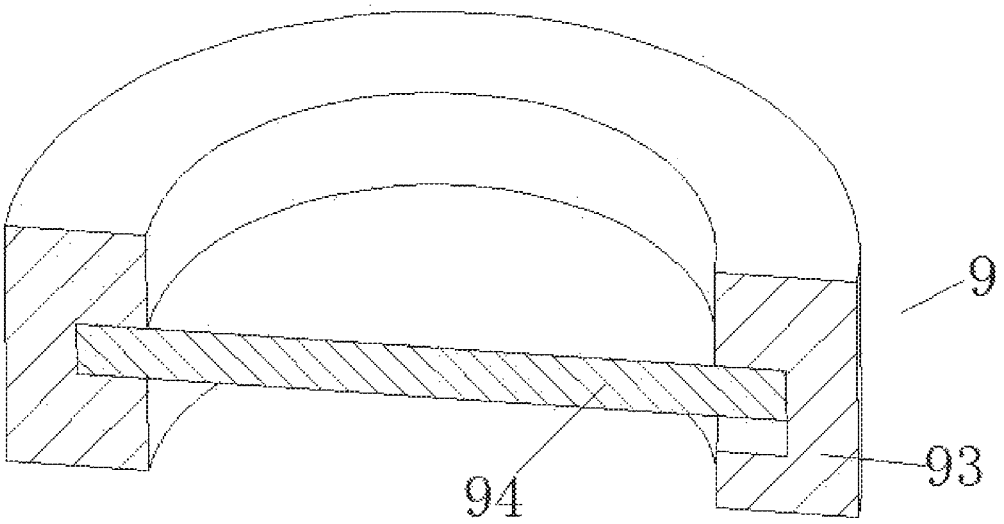
FIG. 27 is an oblique section view of an atomizing core component in the embodiment 5.

The electronic cigarette in the embodiment 5 includes an electronic cigarette shell 63, an atomizing core component 9, a battery bracket 64 in the electronic cigarette shell 63 and a top cover 65 at the top of the electronic cigarette shell 63, the cigarette cartridge is adopted, an atomizing seat thread sleeve 66 is sleeved in a top opening of the top cover 65, the atomizing seat thread sleeve 66 is provided at the top of the battery bracket 64, the atomizing core component 9 is fixedly arranged in the atomizing seat thread sleeve 66, the atomizing core component 9 includes a silica gel seat 93 and an ultrasonic atomizing sheet 94 carried on the silica gel seat 93, and the top surface of the ultrasonic atomizing sheet 94 is in contact with the outer bottom surface of the tobacco tar guide body 4; and a plurality of air inlet grooves 661 communicated with the top surface of the ultrasonic atomizing sheet 94 are formed peripherally in the top of the side wall of the atomizing seat thread sleeve 66. The ultrasonic atomizing sheet 94 is a piezoelectric ceramic ultrasonic atomizing sheet 94. The electronic cigarette further includes a pressing connecting sleeve 67 and a fixing seat 68, the cigarette cartridge connecting sleeve 62 is detachably and fixedly connected with the fixing seat 68, a flange 141 which presses and fixes the fixing seat 68 is arranged at the top of the inner side wall of the pressing connecting sleeve 67, and the outer side wall of the pressing connecting sleeve 67 is screwed with the atomizing seat thread sleeve 66; and a first air guide hole 142 is formed in the side wall of the pressing connecting sleeve 67, a second air guide hole 151 is formed in the side wall of the fixing seat 68, and the air inlet groove 661 is communicated with the atomizing surface of the ultrasonic atomizing sheet 94 through the first air guide hole 142 and the second air guide hole 151 successively, wherein the direction shown by an arrow in FIG. 23 is the airflow direction.

A salient 61 is arranged on the outer side wall of the cigarette cartridge connecting sleeve 62, a neck 152 corresponding to the salient 61 is formed in the inner side wall of the fixing seat 68, a rotating guide rail 153 communicated with the bottom of the neck 152 is formed in the side wall of the fixing seat 68, and an in-place prompting convex rib 154 is arranged on the rotating guide rail 153.

A heat insulation sleeve 69, a spring terminal 70, an insulating ring 71 and an electrode seat 72 located below the atomizing core component 9 are further arranged in the atomizing seat thread sleeve 66, the bottom of the spring terminal 70 is carried and fixed in the electrode seat 72, the top of the spring terminal 70 passes through the heat insulation sleeve 69 and is electrically connected with the ultrasonic atomizing sheet 94, and the side wall of the electrode seat 72 and the side wall of the atomizing seat thread sleeve 66 are insulatedly connected by the insulating ring 71.

A PCB (Printed Circuit Board) bracket 73, an indicator lamp light guide seat 74 on the PCB bracket 73, and a battery core 102 which supplies power to the ultrasonic atomizing sheet 94 are arranged in the electronic cigarette shell 63, and the battery core 102 is arranged in a hollow cavity of the battery bracket 64 below the atomizing seat thread sleeve 66. An indication lamp lampshade 23 corresponding to the indicator lamp light guide seat 74 are further arranged on the top cover 65. A switch 105 which turns on the working circuit of the ultrasonic atomizing sheet 94 is further arranged on the electronic cigarette shell 63.

Embodiment 6

Figure 28:
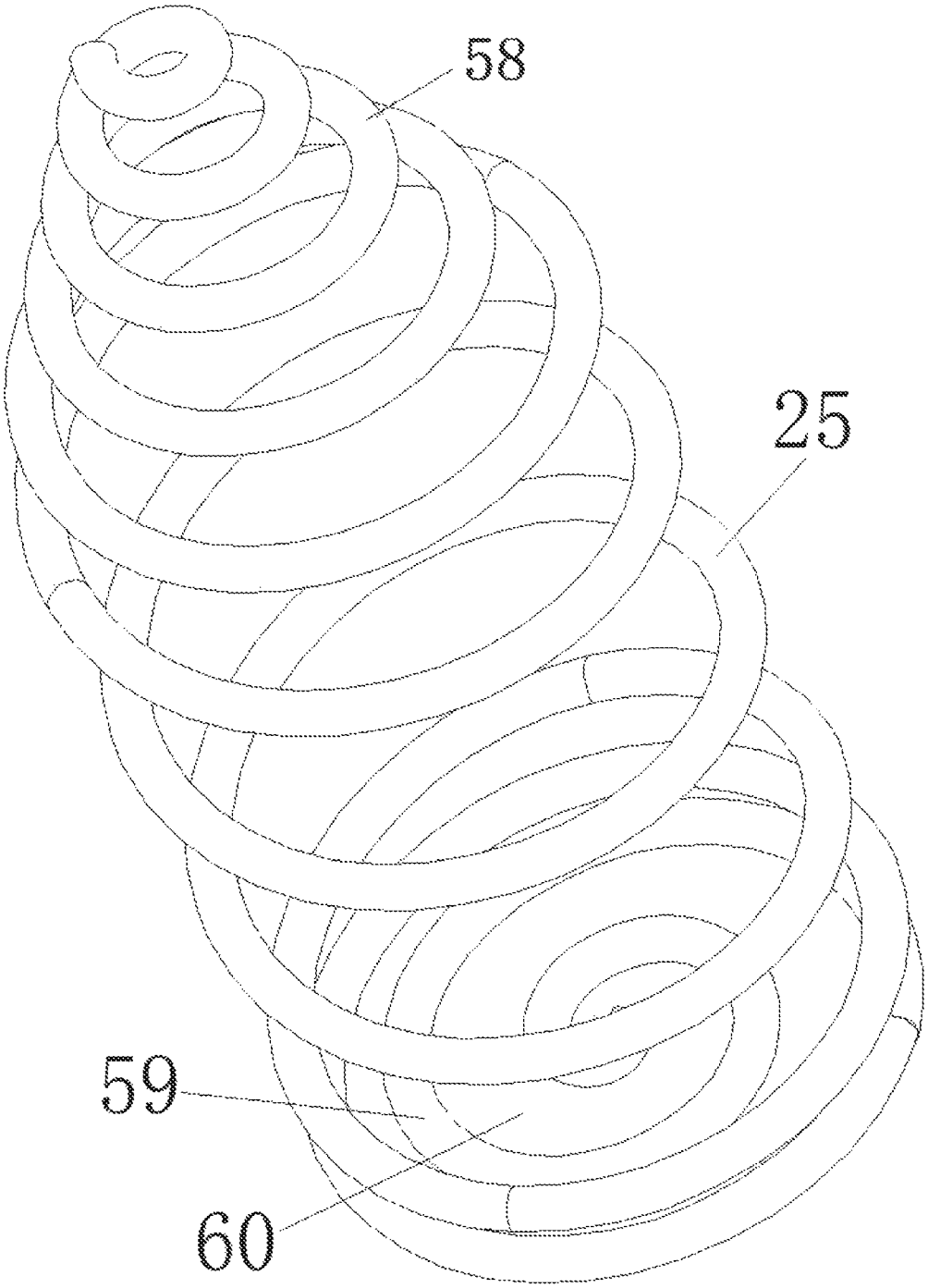
FIG. 28 is a structural schematic diagram of an embodiment 6 of a tobacco tar bead blocking structure.
Figure 29:
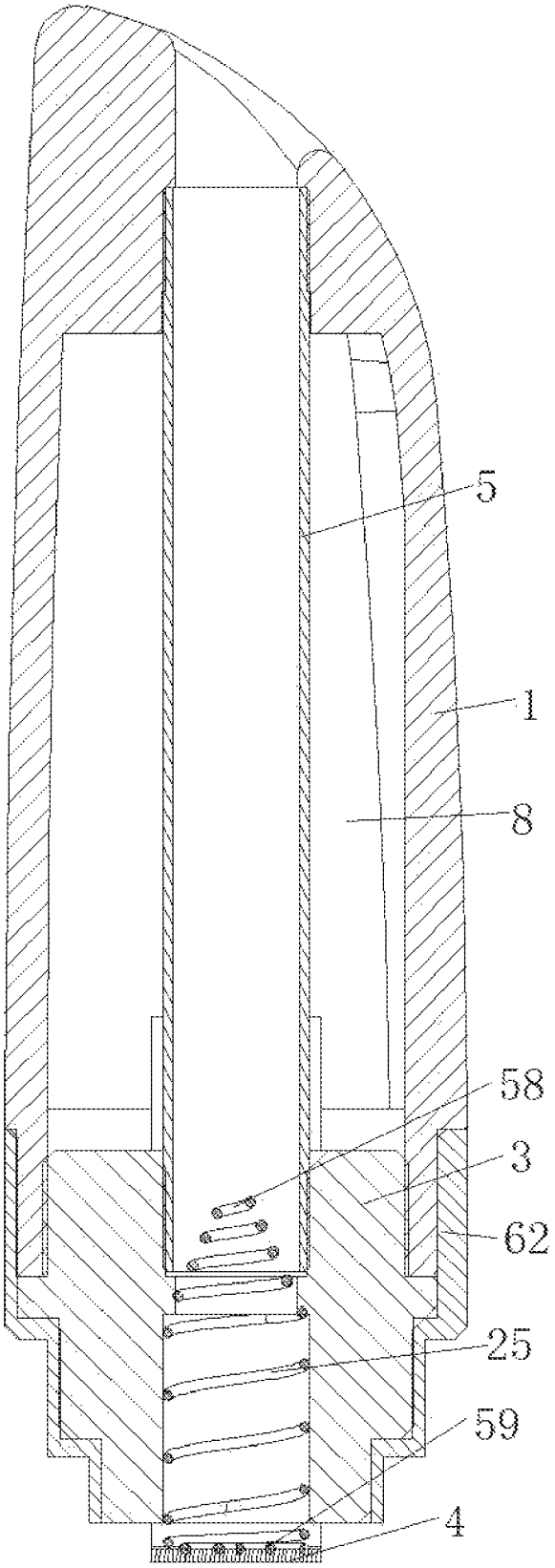
FIG. 29 is a structural schematic diagram of the embodiment 6 of the cigarette cartridge.

The structures of the cigarette cartridge, the atomizer and the electronic cigarette in the embodiment 6 are similar to those in the embodiment 5. The only difference lies in that the position relationship and connection between the tower spring 58 and the cylindrical spring 25 in the tobacco tar bead blocking structure is different. As shown in FIG. 28 and FIG. 29, the tower spring 58 is fixedly connected with the pressing member 59 through a cylindrical spring 25 which is coaxial with the tower spring 58, the bottom of the tower spring 58 and the top of the cylindrical spring 25 are integrally formed, the bottom of the cylindrical spring 25 and the non-contact planar spiral spring are integrally formed, and the diameters of the coils of the tower spring 58 increase progressively from top to bottom. The pressing member 59 is a non-contact planar spiral spring that is vertical to the tower spring 58. The spacing of the non-contact planar spiral spring is greater than a multiple line diameter.

The other structures in the embodiment 6 which are the same as those in the embodiment 5 are not described repeatedly herein, but do not affect the understanding and implementation of the present invention by those skilled in the art.

Although the embodiments of the present invention have been described above with reference to the drawings, the present invention is not limited to the specific embodiments described above, the specific embodiments described above are merely illustrative and not limitative, those of ordinary skill in the art can make many forms in the light of the present invention without departing from the spirit of the present invention and the protection scope of the claims, and these forms all belong to the protection scope of the present invention.

The invention claimed is:

1. A disposable cigarette cartridge detachably connectable with an atomizing core, which comprises an ultrasonic atomizing sheet, the disposable cigarette cartridge comprising a hollow shell, a tobacco tar storage device located in the shell, a suction nozzle connected with the upper end of the shell, a tobacco tar guide seat connected with the lower end of the shell, and a tobacco tar guide body installed on the tobacco tar guide seat;

the tobacco tar guide body extends into the tobacco tar storage device; and an air passage is arranged in the shell, one end of the air passage is communicated with the suction nozzle, and the other end of the air passage is communicated with a heating surface of the tobacco tar guide body;

the disposable cigarette cartridge further comprises a tobacco tar bead blocking structure, wherein the tobacco tar bead blocking structure props against one surface of the tobacco tar guide body away from the ultrasonic atomizing sheet;

the tobacco tar bead blocking structure comprises a tower spring, a pitch value of the tower spring is less than or equal to a line diameter value of the tower spring, the tower spring is located on one side where the atomizing surface of the ultrasonic atomizing sheet is located, and a center line of the tower spring is vertical to the ultrasonic atomizing sheet.

2. The disposable cigarette cartridge according to claim 1, wherein a tobacco tar cup component is arranged in the shell, the tobacco tar cup component comprises a sealed tobacco tar cup shell and a tobacco tar cavity located in the tobacco tar cup shell; the bottom of the tobacco tar cup shell of the tobacco tar cup component is sealed by the tobacco tar guide seat, a recessed portion is arranged at the middle of the tobacco tar guide seat, and a tobacco tar isolation seat is installed in the recessed portion;

the tobacco tar isolation seat is T-shaped and comprises a vertical portion and a flange edge located at the top of the vertical portion, the vertical portion is inserted into the recessed portion, a first gap is reserved between the vertical portion and the inner wall of the recessed portion, the tobacco tar guide cotton is arranged in the first gap, and a tobacco tar pass hole communicated with the tobacco tar cavity is formed in a position corresponding to the tobacco tar guide cotton on the flange edge; and the outer wall of the vertical portion is wrapped with the tobacco tar guide body, the side face of the tobacco tar guide body props against the tobacco tar guide cotton, and the bottom of the tobacco tar guide body props against the ultrasonic atomizing sheet.

3. The disposable cigarette cartridge according to claim 2, wherein a cotton pressing spring is sleeved on the lower end of the vertical portion, the cotton pressing spring is wrapped by the tobacco tar guide body, and the lower end of the cotton pressing spring props against the inner surface of the bottom of the tobacco tar guide body.

4. The disposable cigarette cartridge according to claim 1, wherein the tobacco tar bead blocking structure further comprises a pressing member fixedly arranged at the bottom of the tower spring, an air outlet groove is formed in the pressing member, and the pressing member props against the atomizing surface of the ultrasonic atomizing sheet.

5. The disposable cigarette cartridge according to claim 4, wherein the pressing member is a non-contact planar spiral spring that is vertical to the tower spring.

6. The disposable cigarette cartridge according to claim 5, wherein the tower spring is fixedly connected with the pressing member through a cylindrical spring which is coaxial with the tower spring, the top of the tower spring is connected with the top of the cylindrical spring, the bottom of the cylindrical spring is integrally formed with the non-contact planar spiral spring, and the diameters of the coils of the tower spring decrease progressively from top to bottom.

7. The disposable cigarette cartridge according to claim 5, wherein the tower spring is fixedly connected with the pressing member through a cylindrical spring which is coaxial with the tower spring, the bottom of the tower spring is integrally formed with the top of the cylindrical spring, the bottom of the cylindrical spring is integrally formed with the non-contact planar spiral spring, and the diameters of the coils of the tower spring increase progressively from top to bottom.

8. The disposable cigarette cartridge according to claim 6, wherein the disposable cigarette cartridge further comprises an air pipe, wherein a cigarette cartridge connecting sleeve is connected to the bottom of the side wall of the shell, the tobacco tar guide seat is arranged in the cigarette cartridge connecting sleeve, the tobacco tar guide body is a U-shaped tobacco tar guide cotton sheet, the tobacco tar cavity which accommodates the tobacco tar is enclosed among the tobacco tar guide seat, the shell and the air pipe, the bottom surface of the tobacco tar guide body is located below the tobacco tar guide seat, and the two side walls of the tobacco tar guide body are communicated with the tobacco tar cavity through the tobacco tar pass hole in the tobacco tar guide seat; a vertical vent hole is formed in the tobacco tar guide seat, and the vent hole is communicated with the outside through the air pipe; and a limiting portion which props against the top end of the cylindrical spring is arranged on the side wall of the vent hole, and the non-contact planar spiral spring props against the inner bottom surface of the tobacco tar guide body.

9. The disposable cigarette cartridge according to claim 7, wherein the disposable cigarette cartridge further comprises an air pipe, wherein a cigarette cartridge connecting sleeve is connected to the bottom of the side wall of the shell, the tobacco tar guide seat is arranged in the cigarette cartridge connecting sleeve, the tobacco tar guide body is a U-shaped tobacco tar guide cotton sheet, the tobacco tar cavity which accommodates the tobacco tar is enclosed among the tobacco tar guide seat, the shell and the air pipe, the bottom surface of the tobacco tar guide body is located below the tobacco tar guide seat, and the two side walls of the tobacco tar guide body are communicated with the tobacco tar cavity through the tobacco tar pass hole in the tobacco tar guide seat; a vertical vent hole is formed in the tobacco tar guide seat, and the vent hole is communicated with the outside through the air pipe; and a limiting portion which props against the top end of the cylindrical spring is arranged on the side wall of the vent hole, and the non-contact planar spiral spring props against the inner bottom surface of the tobacco tar guide body.

10. An atomizer, comprising an atomizing core component, wherein the atomizing core component comprises the ultrasonic atomizing sheet, and the disposable cigarette cartridge according to claim 1, and the outer bottom surface of the tobacco tar guide body props against the atomizing surface of the ultrasonic atomizing sheet.

11. An electronic cigarette, comprising a power supply module, wherein the electronic cigarette further comprises the atomizer according to claim 10, and the power supply module is electrically connected with the ultrasonic atomizing sheet.

12. The electronic cigarette according to claim 11, wherein the disposable cigarette cartridge is detachably connected with the atomizing core component, the power supply module is electrically connected with the lower end of the atomizing core component, the tobacco tar guide seat is fixed in a cigarette cartridge connecting sleeve, and the cigarette cartridge connecting sleeve is connected with the upper end of the atomizing core component.

13. The electronic cigarette according to claim 12, wherein the atomizing core component comprises a hollow atomizing core shell, an air inlet hole located in the wall of the atomizing core shell, a silica gel seat arranged in a hollow cavity of the atomizing core shell, the ultrasonic atomizing sheet arranged on the silica gel seat, a connecting electrode electrically connected with the ultrasonic atomizing sheet, and a pressing device which presses the ultrasonic atomizing sheet;

the air inlet hole is communicated with the hollow cavity of the atomizing core shell; and the pressing device is detachably connected with the tobacco tar guide seat, and after assembly and connection, the tobacco tar guide body props against the atomizing surface of the ultrasonic atomizing sheet, and the hollow cavity of the atomizing core shell is communicated with the air passage of the disposable cigarette cartridge.

14. The electronic cigarette according to claim 11, wherein a tobacco tar cup component is arranged in the shell, the tobacco tar cup component comprises a sealed tobacco tar cup shell and a tobacco tar cavity located in the tobacco tar cup shell; the bottom of the tobacco tar cup shell of the tobacco tar cup component is sealed by the tobacco tar guide seat, a recessed portion is arranged at the middle of the tobacco tar guide seat, and a tobacco tar isolation seat is installed in the recessed portion;

the tobacco tar isolation seat is T-shaped and comprises a vertical portion and a flange edge located at the top of the vertical portion, the vertical portion is inserted into the recessed portion, a first gap is reserved between the vertical portion and the inner wall of the recessed portion, the tobacco tar guide cotton is arranged in the first gap, and a tobacco tar pass hole communicated with the tobacco tar cavity is formed in a position corresponding to the tobacco tar guide cotton on the flange edge; and the outer wall of the vertical portion is wrapped with the tobacco tar guide body, the side face of the tobacco tar guide body props against the tobacco tar guide cotton, and the bottom of the tobacco tar guide body props against the ultrasonic atomizing sheet;

the electronic cigarette comprises an air inlet, a suction nozzle component installed at the top of the shell, an ultrasonic atomizing sheet arranged in the shell, and a connecting electrode installed at the bottom of the shell, the tobacco tar cup component props against the ultrasonic atomizing sheet, and the tobacco tar guide body props against the ultrasonic atomizing sheet;

the suction nozzle component is detachably connected with the top of the shell, and the tobacco tar cup component is detachably connected with the shell; and an air inlet passage communicated with the air inlet is formed in the shell, and the air inlet passage extends to the atomizing surface of the ultrasonic atomizing sheet; and an air outlet passage communicated with the suction nozzle component is arranged in the shell;

and the ultrasonic atomizing sheet is electrically connected with the connecting electrode.

15. The electronic cigarette according to claim 14, wherein a second gap is reserved between the outer wall of the tobacco tar cup shell of the tobacco tar cup component and the inner wall of the shell, and the second gap forms a first air inlet passage; an elastic sheet is arranged around the edge of the ultrasonic atomizing sheet, a first air pass groove communicated with the first air inlet passage is formed in the elastic sheet, and the first air pass groove is communicated with the atomizing surface of the ultrasonic atomizing sheet;

a first air pass hole communicated with the first air inlet passage is formed in the lower part of the tobacco tar guide body, and a first air outlet hole is formed in the bottom of the tobacco tar guide body; and the air outlet passage comprises an air pipe located in the tobacco tar cup component, one end of the air pipe is communicated with the suction nozzle component, and the other end of the air pipe penetrates through the tobacco tar isolation seat, is inserted into a center hole of the cotton pressing spring and is communicated with the first air outlet hole.

16. The electronic cigarette according to claim 15, wherein a segment of flexible pipe is arranged between the air pipe and the first air outlet hole, and one end of the flexible pipe props against the inner bottom surface of the tobacco tar guide body and is communicated with the first air outlet hole; and the other end of the flexible pipe is sleeved with the air pipe.

17. The electronic cigarette according to claim 15, wherein the suction nozzle component comprises a suction nozzle seat and a suction nozzle installed on the suction nozzle seat, a through-hole communicated with the suction nozzle is formed in the suction nozzle seat, and the through-hole is communicated with the air pipe; and the suction nozzle seat is detachably connected with the top of the shell.

18. The electronic cigarette according to claim 15, wherein the shell of the tobacco tar cup component is made of a transparent material, the air inlet is arranged at a position corresponding to the tobacco tar cup shell in the side wall of the shell, and the length of the air inlet is equal to the height of the tobacco tar cavity.

19. The electronic cigarette according to claim 15, wherein the air inlet is arranged at a position aligned to the ultrasonic atomizing sheet in the wall of the shell, a flexible air guide sheet is arranged above the ultrasonic atomizing sheet, the air guide sheet comprises a sheet-like body, a second air pass hole located at the middle of the sheet-like body, and a boss arranged around the edge of the sheet-like body, and a second air pass groove is formed in the boss;

a second air inlet passage is formed between the air guide sheet and the ultrasonic atomizing sheet, a third air pass hole communicated with the second air inlet passage is formed in the lower part of the tobacco tar guide body, and a second air outlet hole is formed in the bottom of the tobacco tar guide body;

the tobacco tar guide seat of the tobacco tar cup component props against the boss of the air guide sheet, and a first air outlet passage is formed between the bottom of the tobacco tar guide seat and the sheet-like body;

a third air outlet hole is formed in a position aligned to the first air outlet passage on the side face of the tobacco tar guide body;

a third gap is reserved between the outer wall of the tobacco tar cup shell of the tobacco tar cup component and the inner wall of the shell, the third gap forms a second air outlet passage, and the second air outlet passage is communicated with the first air outlet passage;

a fourth gap is reserved between the suction nozzle component and the top of the tobacco tar cup shell of the tobacco tar cup component, the fourth gap forms a third air outlet passage, and the third air outlet passage is communicated with the second air outlet passage and the suction nozzle component.

20. The electronic cigarette according to claim 19, wherein the suction nozzle component comprises a suction nozzle seat and a suction nozzle installed on the suction nozzle seat, and a through-hole communicated with the suction nozzle is formed in the suction nozzle seat;

a side hole communicated with the third air outlet passage is formed in the side edge of the suction nozzle seat; and the suction nozzle seat is detachably connected with the top of the shell.

21. The electronic cigarette according to claim 11, wherein the tobacco tar bead blocking structure further comprises a pressing member fixedly arranged at the bottom of the tower spring, an air outlet groove is formed in the pressing member, and the pressing member props against the atomizing surface of the ultrasonic atomizing sheet;

the pressing member is a non-contact planar spiral spring who is vertical to the tower spring;

the tower spring is fixedly connected with the pressing member through a cylindrical spring which is coaxial with the tower spring, the top of the tower spring is connected with the top of the cylindrical spring, the bottom of the cylindrical spring is integrally formed with the non-contact planar spiral spring, and the diameters of the coils of the tower spring decrease progressively from top to bottom;

the electronic cigarette comprises an electronic cigarette shell, a battery bracket in the electronic cigarette shell and a top cover at the top of the electronic cigarette shell, an atomizing seat thread sleeve is sleeved in a top opening of the top cover, the atomizing seat thread sleeve is provided at the top of the battery bracket, the atomizing core component is fixedly arranged in the atomizing seat thread sleeve, the atomizing core component comprises a silica gel seat and an ultrasonic atomizing sheet carried on the silica gel seat, and the top surface of the ultrasonic atomizing sheet is in contact with the outer bottom surface of the tobacco tar guide body; and an air inlet groove communicated with the top surface of the ultrasonic atomizing sheet is formed in the top of the side wall of the atomizing seat thread sleeve.

22. The electronic cigarette according to claim 11, wherein the tobacco tar bead blocking structure further comprises a pressing member fixedly arranged at the bottom of the tower spring, an air outlet groove is formed in the pressing member, and the pressing member props against the atomizing surface of the ultrasonic atomizing sheet;

the pressing member is a non-contact planar spiral spring that is vertical to the tower spring;

wherein the tower spring is fixedly connected with the pressing member through a cylindrical spring which is coaxial with the tower spring, the bottom of the tower spring is integrally formed with the top of the cylindrical spring, the bottom of the cylindrical spring is integrally formed with the non-contact planar spiral spring, and the diameters of the coils of the tower spring increase progressively from top to bottom;

the electronic cigarette comprises an electronic cigarette shell, a battery bracket in the electronic cigarette shell and a top cover at the top of the electronic cigarette shell, an atomizing seat thread sleeve is sleeved in a top opening of the top cover, the atomizing seat thread sleeve is provided at the top of the battery bracket, the atomizing core component is fixedly arranged in the atomizing seat thread sleeve, the atomizing core component comprises a silica gel seat and an ultrasonic atomizing sheet carried on the silica gel seat, and the top surface of the ultrasonic atomizing sheet is in contact with the outer bottom surface of the tobacco tar guide body; and an air inlet groove communicated with the top surface of the ultrasonic atomizing sheet is formed in the top of the side wall of the atomizing seat thread sleeve.

23. The electronic cigarette according to claim 22, wherein the electronic cigarette further comprises a pressing connecting sleeve and a fixing seat, the cigarette cartridge connecting sleeve is detachably and fixedly connected with the fixing seat, a flange which presses and fixes the fixing seat is arranged at the top of the inner side wall of the pressing connecting sleeve, and the outer side wall of the pressing connecting sleeve is screwed with the atomizing seat thread sleeve; and a first air guide hole is formed in the side wall of the pressing connecting sleeve, a second air guide hole is formed in the side wall of the fixing seat, and the air inlet groove is communicated with the atomizing surface of the ultrasonic atomizing sheet through the first air guide hole and the second air guide hole successively.

24. The electronic cigarette according to claim 23, wherein a salient is arranged on the outer side wall of the cigarette cartridge connecting sleeve, a neck corresponding to the salient is formed in the inner side wall of the fixing seat, a rotating guide rail communicated with the bottom of the neck is formed in the side wall of the fixing seat, and an in-place prompting convex rib is arranged on the rotating guide rail.

* * * * *